US005223849A

United States Patent [19]

Kasevich et al.

[11] Patent Number: 5,223,849

[45] Date of Patent: Jun. 29, 1993

[54] BROADBAND ELECTROMAGNETIC ENERGY ABSORBER

[75] Inventors: Raymond S. Kasevich, Weston; John F. Broderick, Andover, both of Mass.

[73] Assignee: Chomerics, Inc., Woburn, Mass.

[21] Appl. No.: 177,518

[22] Filed: Apr. 11, 1988

Related U.S. Application Data

[63] Continuation-in-part of Ser. No. 10,448, Feb. 3, 1987, abandoned, which is a continuation-in-part of Ser. No. 934,716, Nov. 25, 1986, abandoned.

[51] Int. Cl.[5] ..... H01Q 1/36

[52] U.S. Cl. ..... 343/895

[58] Field of Search ..... 343/700 MS, 708, 895; 342/1, 4

[56] References Cited

U.S. PATENT DOCUMENTS

| | | | |
|---|---|---|---|
| 3,185,986 | 5/1965 | McCaughna et al. | 342/1 |
| 4,439,768 | 3/1984 | Ebneth et al. | 342/1 X |
| 4,525,720 | 6/1985 | Corzine et al. | 343/895 |
| 4,539,433 | 9/1985 | Ishino et al. . | |
| 4,605,934 | 8/1986 | Andrews | 343/895 |
| 4,675,690 | 6/1987 | Hoffman | 343/895 |
| 4,684,952 | 8/1987 | Munson et al. | 343/700 MS |
| 4,742,354 | 5/1988 | Wen et al. | 343/700 MS |

*Primary Examiner*—Theodore M. Blum
*Attorney, Agent, or Firm*—Wolf, Greenfield & Sacks

[57] ABSTRACT

A radar absorbing material comprising multiple layers integrated to form a thin flexible and light weight structure. The material includes a substrate disposed thereon antenna elements that are relatively loaded to enable one to construct a device in relatively small and thin size. The broad handling of the device is carried out by multi-layering concepts in which different size antenna patterns are multi-layered with each layer designed to absorb frequencies in s specified range. The antenna elements are selected for their intrinsic broadband properties and to preferably be polarization insensitive.

72 Claims, 22 Drawing Sheets

BROADBAND ELECTROMAGNETIC ENERGY ABSORBER

RELATED APPLICATION

This application is a continuation in part of application Ser. No. 07/010448 Filed Feb. 3, 1987, which in turn is a continuation in part of application Ser. No. 06/934716 filed Nov. 25, 1986, both abandoned.

BACKGROUND OF THE INVENTION

The present invention relates in general to radar absorbing materials. More particularly, the invention pertains to an electro-magnetic energy absorber that is characterized by broadband operation. Even more particularly, the invention relates to an electro-magnetic energy absorber that is thin, flexible, lightweight, and preferably operates in a frequency band of 2–18 GHz with less than —15 dB reflectivity.

Two basic forms of radar absorbers are referred to in the prior art as a Salisbury screen and a Dallenbach layer. The Salisbury screen is a resonant absorber formed by placing a resistive sheet on a low dielectric constant spacer in front of a metal plate. The Dallenbach layer consists of a homogeneous lossy layer back by a metal plate. The Salisbury screen has found some limited usage, but is generally ineffective for broadband applications. One of the problems with the Dallenbach layer is the difficulty in providing the proper match of materials. Also, the Dallenbach layer does not provide sufficient bandwidth.

Much effort has been carried out in the past in an attempt to extend the bandwidth of radar absorbers through the use of multiple layers. In this regard, see by way of example, U.S. Pat. No. 2,951,247 to Halpern, et al, U.S. Pat. No. 2,992,425 to Pratt and U.S. Pat. No. 2,771,602 to Kuhnhold. Also refer to British patent 665,747.

In these prior art absorbers, the intention of the use of multiple layers is to slowly change the effective impedance from free space to zero ohms with distance into the material so as to minimize reflections or to provide an input impedance that matches that of free space as closely as possible over a selected range of frequencies. There are, generally speaking, two different types of multi-layer absorbers that are common in the art. These are referred to as the Jaumann absorber, and the graded dielectric absorber. All of these absorbers require the use of multiple layers and are typically relatively thick. Existing broadband radar absorbing materials require thickness of at least one or two inches to achieve any significant bandwidth. Also, the manufacturing process is relatively complex because of the multi-layering of different materials that are used to obtain the broadband enhancement. One example of a commercially available graded dielectric absorber is one made by Emerson & Cumming. This is referred to as their Model No. AN-74 which is a three-layer foam absorber that is over one inch thick.

Accordingly, it is an object of the present invention to provide an improved radar absorbing material that has excellent broadband characteristics and that is yet thin, preferably flexible and light in weight.

Another object of the present invention is to provide an improved radar absorbing material that is in particular usable over a frequency range of 2–18 GHz with preferred reflectivity of less than −15 dB.

A further object of the present invention is to provide a radar absorber that is relatively simple in construction and that can be easily manufactured in production quantities at relatively low cost.

A further object of the present invention is to provide an improved radar absorber in which the overall material thickness is made quite small by employing a process that includes the step of printing antenna patterns using a preferred resistive ink and wherein the antenna patterns may be printed using silk screening techniques.

Another object of the present invention is to provide an improved radar absorber that is characterized by its broadband absorption, and yet is carried out with a thin structure at least an order of magnitude thinner than one inch.

A further object of the invention is to provide an improved radar absorber that is in particular adapted for high temperature applications.

SUMMARY OF THE INVENTION

To accomplish the foregoing and other objects, features and advantages of the invention, there is provided, in accordance with one aspect of the present invention, a radar absorbing apparatus for absorbing an electromagnetic energy wave having frequency signal content in a frequency range including 2–18 GHz. The apparatus comprises an electrically conductive reflector means that may comprise a metallic layer, and an antenna array that is comprised of a plurality of discrete antenna elements. The antenna elements may comprise, for example, dipole antenna elements or spiral antenna elements. Means are provided for supporting the antenna elements from and in front of the electrically conductive reflector means. The antenna elements are disposed in at least a first planar antenna array. In accordance with the invention, it has been realized that, instead of using a one-half-wavelength spacing between the antenna element and the reflector to obtain maximum signal absorption, spacings between the antenna element and the reflector of less than one-tenth wavelength may be used as long as the antenna element is resistively loaded. Thus, in accordance with the invention, means are provided for resistively loading each of the antenna elements. Furthermore, as already stated, the antenna array is disposed at a distance from the reflector means on the order of one-tenth wavelength or less of the electromagnetic energy wave. The resistive loading referred to herein may be accomplished by means of providing a resistor at a terminal of the antenna element. Alternatively, a resistively loaded antenna element may be achieved by printing the antenna element on a dielectric substrate with a resistively loaded ink. The antenna array patterns may easily be fabricated on the dielectric substrate using silk screen or other transfer methods. The antenna elements furthermore are selected from a class of broadband antenna elements known as frequency independent antennas.

In accordance with a further aspect of the present invention, there is provided a radar absorber that is designed for broadband absorption. In accordance with the invention, there is provided for the multi-layering of different size antenna patterns, one particular size for a given layer, to achieve a broadband three-dimensional antenna array with each layer adapted to absorb frequencies in a specified range because of the particular antenna geometry employed for that particular layer. The overall material thickness is relatively small because of the preferred use of resistive loading as referred to hereinbefore and also because of the use of the printing of the antenna patterns using a resistive ink on an appropriate dielectric substrate. In accordance with the invention, the broadband radar absorbing apparatus comprises an electrically conductive reflector means, a first antenna array comprised of a plurality of discrete antenna elements, and means for supporting the first antenna array from and in front of the electrically conductive reflector means and in at least a first planar antenna configuration. The first antenna array is adapted for absorption over a first predetermined frequency segment including in the frequency range. The multi-layering is accomplished by at least a second antenna array also comprised of a plurality of discrete antenna elements along with means for supporting the second antenna array spaced from the first antenna array and remote from the reflector means. The second antenna array is adapted for absorbing electromagnetic energy in a second frequency segment included in the frequency range. By providing still further antenna arrays, a substantially wide frequency spectrum may be covered.

In accordance with still further aspect of the present invention, there is provided a radar absorber that is optimized for broadband absorption while at the same time is adapted to be constructed in a relatively thin configuration. This is carried out in the present invention by providing in a single layer, different forms, and in particular, different sizes, of antenna elements, each different form or size essentially being tuned at different frequencies so as to provide broadbanding even in a single antenna array layer. In this way there can be provided bandwidth enhancement using even a single layer antenna configuration. In this regard, there is provided a radar absorbing apparatus for absorbing an electro-magnetic energy wave having the frequency signal content in a frequency range including 2–18 GHz. This apparatus comprises an electrically conductive reflector means, an antenna array comprised of a plurality of discrete antenna elements, and means for supporting the antenna elements from and in front of the electrically conductive reflector means and in a planar antenna configuration. The antenna include elements of first and second different size. The first size antenna elements are adapted for absorption primarily over a first frequency segment included in the frequency range. The second size antenna elements are adapted for absorption primarily over a second frequency segment included in the frequency range. By way of example, these two different size antenna elements may both be different size spiral antenna elements. The antenna elements of first size are preferably interspersed with the antenna elements of second size. Also described are configurations in which the first size antenna elements are trapezoidal and the second size antenna elements are spiral. Another configuration illustrates the first size antenna elements are being zig-zag elements while the second size elements are spiral.

In accordance with still another aspect of the present invention, spiral antenna configurations are described employing both separate and continuous spirals of varying spiral spacing. One embodiment has an open central segment in the spiral while still another embodiment employs a ferrite disk at the center of the spiral. A further configuration is one in which there is provided a main spiral configuration altered to receive plural smaller spiral configurations.

BRIEF DESCRIPTION OF THE DRAWINGS

Numerous other objects, features, and advantages of the invention should now become apparent upon a reading of the following detailed description taken in conjunction with the accompanying drawing, in which.

DETAILED DESCRIPTION

Figure 6:
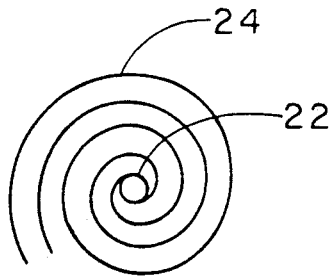
FIG. 6 is a fragmentary view illustrating one means by which the antenna element may be resistively loaded as specifically applies to a spiral configuration.

In accordance with the present invention, there is provided a thin, flexible, lightweight and broadband radar absorbing material. The apparatus that is described herein is in particular designed for operation in the frequency range of 2–18 GHz and is adapted to provide operation with reflectivities of less than −15 dB. The apparatus to be described hereinafter is characterized by at least two important features. One feature relates to a resistive loading technique to enable one to construct the device in relatively small and thin size. The other concept is a broadbanding technique that is carried out by multi-layering concepts. In this regard, different size antenna patterns are multi-layered to achieve a broadband three-dimensional antenna array in which each layer is designed to absorb frequencies in s specified range because of the particular antenna geometry employed for that layer. The overall material thickness is made small by printing the antenna patterns, preferably using either a resistive ink in which the loading is substantially uniform throughout the pattern, or a highly conductive ink in combination with a discrete resistive load. In the case of using a resistive ink for the antenna pattern, the antenna may be either open-circuited or short-circuited at the antenna feed gap. In the case of using a highly conductive ink, the resistive loading is at the feed gap such as illustrated in FIG. 6. The antenna patterns are printed on an appropriate substrate using silk screening or other transfer methods.

Figure 1:
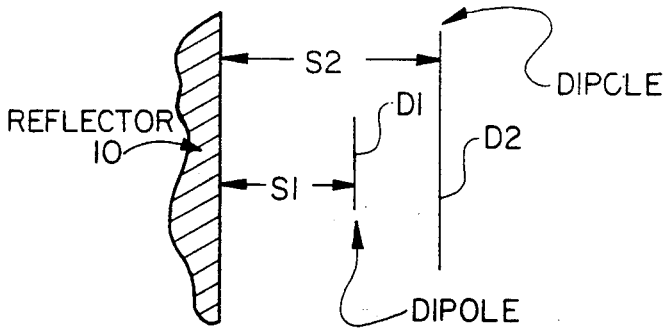
FIG. 1 is a schematic diagram illustrating the principles of the present invention as they relate to multiple antenna arrays in association with a reflector.

Reference is now made to the schematic diagram of FIG. 1 which shows a metal sheet 10 forming a reflector having disposed in front thereof, dipoles D1 and D2 at respective spacings S1 and S2 from the reflector surface. It is noted that the dipole D1 is of shorter length than the dipole D2. From antenna theory and considering only the dipole D1, it is known that a half wavelength dipole antenna in front of a metal sheet such as the reflector 10 has zero radiation away from the sheet when the dipole is spaced on-half wavelength from the sheet or in other works when the distance S1 is one-half wavelength of the particular electromagnetic energy signal. The zero field intensity come about by interference of the waves, one reflected from the plate 10 and one transmitted by the antenna. By reciprocity, if the dipole is receiving electromagnetic energy in the form of a plane wave, it re-radiates zero power at this one-half wavelength spacing.

Now, in accordance with the present invention, it has been found that if the dipole is loaded with a resistor, there also is provided substantially zero gain, but at a spacing on the order of or less than one-tenth wavelength. Thus, also by reciprocity, if the closely spaced dipole is receiving electromagnetic energy in a plane wave, it re-radiates zero power at this one-tenth wavelength or less spacing.

Figure 7:
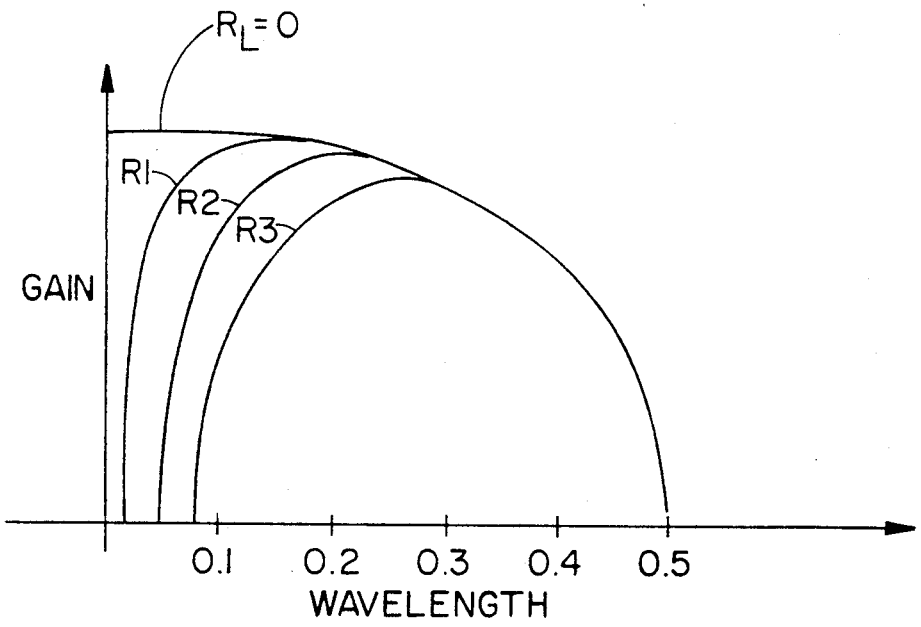
FIG. 7 is a graph of frequency or wavelength versus gain that is important in illustrating one of the principles of the present invention that enables reduced size absorbers.

In connection with the resistive loading of the antenna, refer to FIG. 7 which is a diagram of wavelength versus gain showing a family of curves relating to different load resistance. In FIG. 7 it is noted that the curve for zero load resistance is essentially maintained at a constant value for small wavelengths. Therefore, it is not possible to achieve zero-re-radiated power for very small spacings between the antenna and ground plane under the condition of the load resistance being zero. On the other hand, the other curves indicate that as the resistive loading increase in value, then there will be zero gain and thus zero re-radiation also at spacings generally less than one-tenth wavelength. Reference will be made hereinafter to techniques for carrying out the resistive loading of the antenna element.

In addition to the concepts of reducing the thickness of the absorber by the resistive loading technique, a broadband apparatus is provided by the multi-layering technique of the present invention. This is schematically illustrated in FIG. 1 by showing a first dipole D1 that may be considered as in a first layer and a second dipole D2 that may be considered as in a second layer. It is noted that the dipole D2 is spaced further from the reflector than the dipole D1. The dipole D1 relates to the absorption of a higher frequency signal than that of dipole D2.

Figure 2:
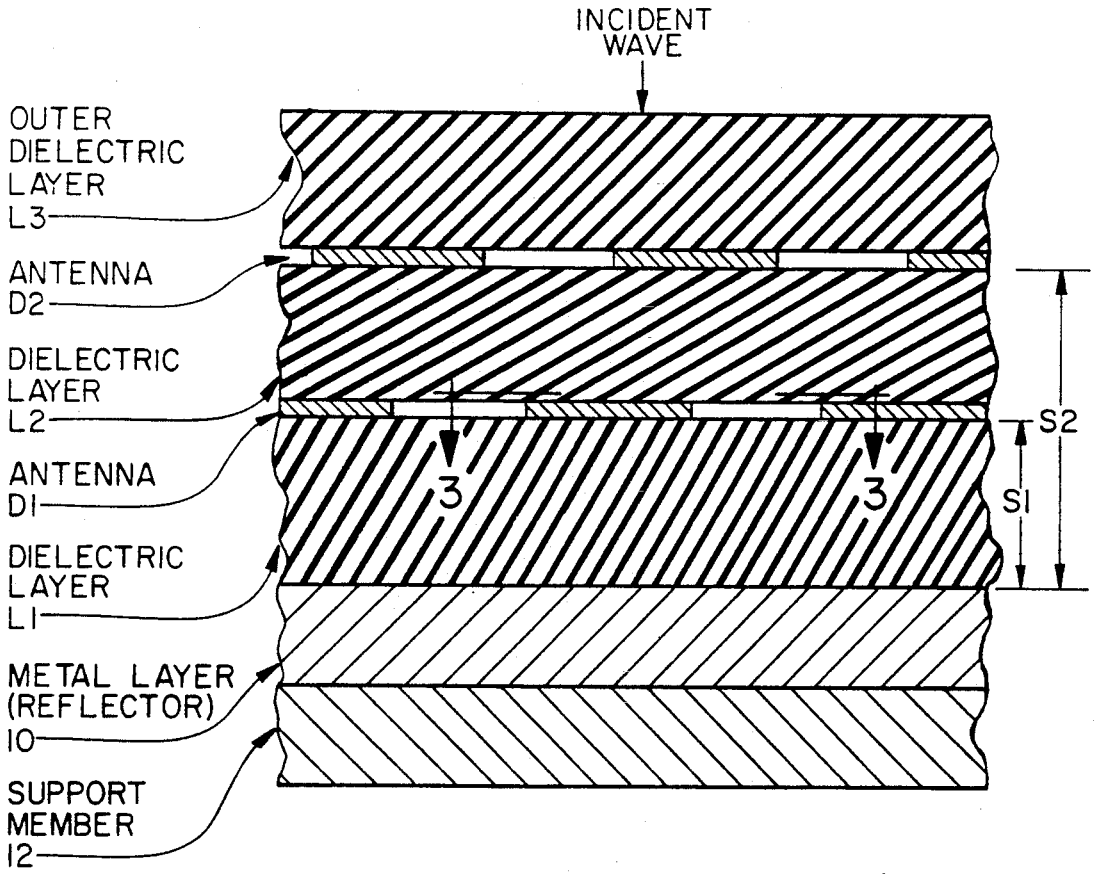
FIG. 2 is an enlarged fragmentary view of the radar absorbing apparatus of the present invention in a form employing dipole antenna elements.

Reference is now made to the fragmentary view of FIG. 2 which shows somewhat further detail of the absorber in accordance with the invention. FIG. 2 illustrates the metal sheet or plate 10 that is supported from some type of a support member illustrated generally at 12 in FIG. 2. Each of the dipoles D1 are supported on a dielectric layer L1. Similarly, each of the dipoles D2 are supported on a dielectric layer L2. There may also preferably be provided an outer dielectric layer L3.

Each of the different layers illustrated in FIG. 2 may be suitably secured to form an integral absorber apparatus adapted to be supported from the support member 12. It is noted that FIG. 2 also illustrates the spacings S1 and S2 associated with the arrays of dipoles D1 and D2, respectively. Also noted in FIG. 2 are the different sizes of dipoles D1 and D2 as referred to schematically hereinbefore in connection with FIG. 1.

It is also preferred to provide loading of the dielectric layers such as the layers L1–L3 in FIG. 2. The loading is such as to optimize both the magnetic and dielectric properties of the layers. This loading may be, for example, by means of glass spheres, carbon particles, rutile, graphite, and/or ferrites. The loading provides better overall performance particularly in terms of bandwidth and reflectivity.

The aforementioned loading may also be implemented by means of a thin layer or coating of a lossy material such as graphite or a ferrite/graphite mixture in an epoxy base. This coating provides improved overall performance, particularly in terms of bandwidth and reflectivity. The coating may be provided at any convenient place in the absorber. For example, the coating may be provided on layer L3 in FIG. 2, over the antenna pattern layer (D1 or D2), or between the antenna pattern and ground plane.

Figure 3:
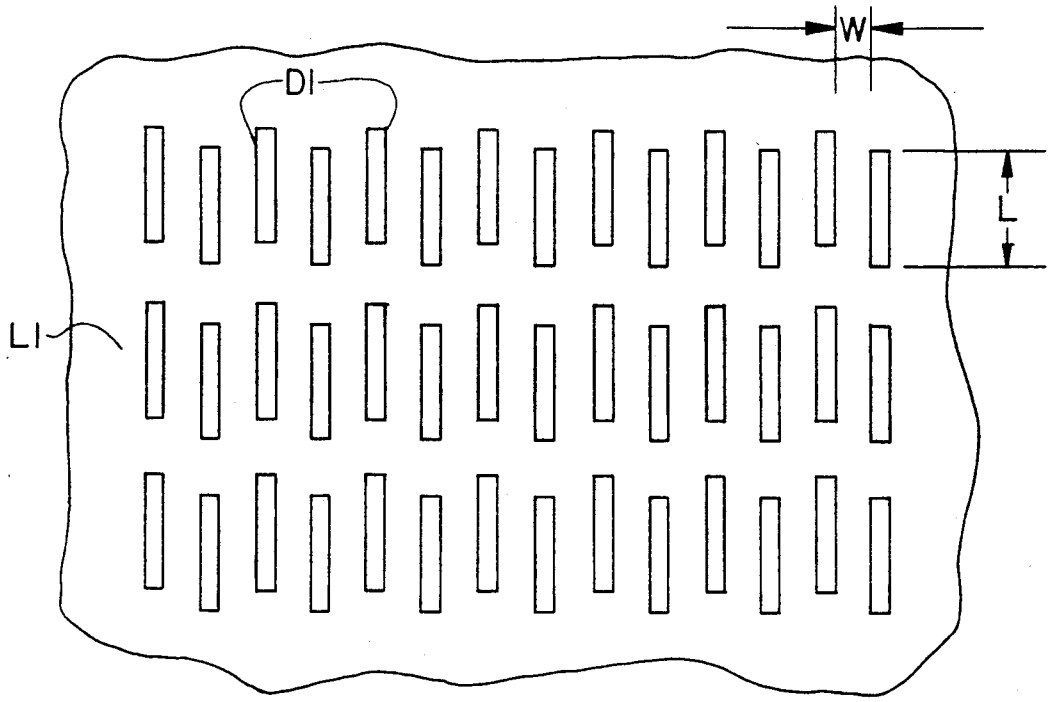
FIG. 3 is a plan view taken along line 3–3 of FIG. 2 illustrating the somewhat staggered placement of the dipole antenna elements arranged in a two-dimensional array.

Reference is also now made to FIG. 3 that illustrates the dielectric layer L1 with associated dipoles D1. FIG. 3 clearly illustrates the manner in which the dipoles D1 are maintained in a somewhat staggered two-dimensional array. Each of the dipoles may have a length L of one-half wavelength. The spacing W between dipoles may be one-quarter wavelength. The staggering of the dipoles as illustrated in FIG. 3 minimized the detrimental effects of mutual coupling between antenna elements or dipoles.

The dielectric layers L1–L3 illustrated in FIG. 2 may be constructed of different types of dielectric materials. One particular material that has been used extensively for these dielectric layers is synthetic rubber.

Figure 4:
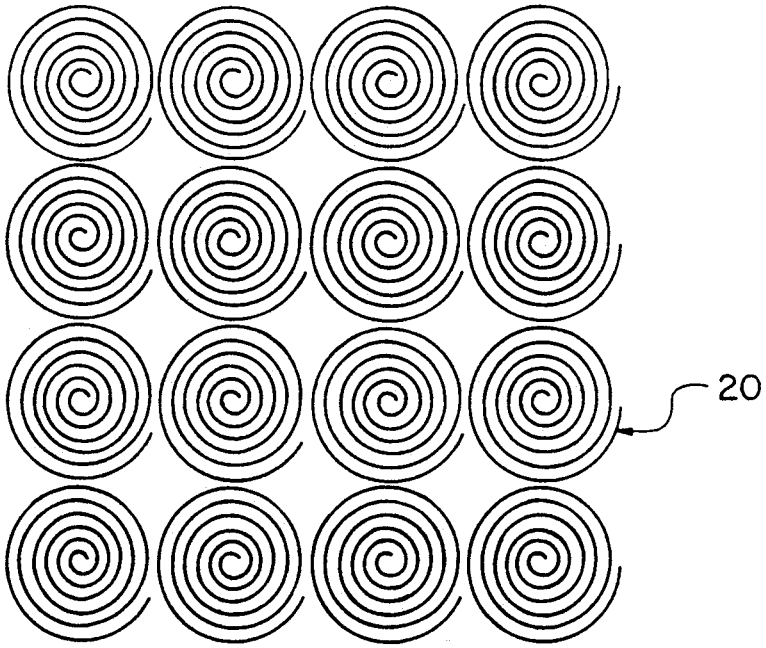
FIG. 4 is an array of antenna elements in which each of the elements is of spiral configuration as in accordance with an alternate embodiment of the invention.

Thus, there is provided an array of dipoles of different lengths as the array extends away from the sheet reflector 10. The shorter dipoles D1 are nearer to the reflector 10 and the longer dipoles are further away. In FIG. 2 there are illustrated two arrays of dipoles. However, it is understood that there may be more than two separate dipole arrays. Furthermore, each of the antenna elements may be of other construction such as illustrated in FIG. 4 herein, in which the antenna element is of spiral configuration. The spaced layers of antenna elements are designed to form, log-periodic type structures in the frequency range of 2 to 18 GHz. The log-periodic structure provides improved bandwidth performance.

In accordance with one embodiment of the present invention, the shortest antenna element may have a length of 0.83 centimeters which is one-half wavelength resonance at 18 GHz. The longest element has a length of 7.5 centimeters. This corresponds to one-half wavelength resonance at 2 GHz. The antenna elements in between the aforementioned shortest and longest elements may be distributed on some type of a log-periodic basis. In FIG. 3 the dimension W is typically one-quarter wavelength as measured in the dielectric material and not in free space.

As referred to in FIG. 2, the array of dipoles D1 are on a dielectric layer L1. These dipoles may be printed on the dielectric substrate in which case they are very compact in design for a minimum of back scattering energy over a broad range of frequencies. However, in accordance with one initial embodiment of the present invention, a two foot square sample of dipoles has been fabricated on a cardboard sheet that forms the dielectric layer L1. The dipoles are fabricated from steel/nickel plated, size 20–1 $\frac{1}{4}$ inch dress maker's pins that are cut to be resonant at say 5 GHz and 10 GHz. One embodiment was comprised of a two-dimensional array of 1.2 inch length pins along with a smaller two-dimensional array of 0.6 inch length pins. As it relates to FIG. 1, this means that the dipole D1 is 0.6 inch in length and the dipole D2 is 1.2 inch in length. The pins are spaced in-plane, one-quarter wavelength apart (0.6 inch apart for the 1.2 inch length and 0.3 inch apart for the 0.6 inch length pins). The overall reflectivity for this system of two sheets is such that resonant peaks were measured at approximately 5.74 GHz and 9.0 GHz. The reflectivities measured are −25 dB (less than one percent of the incident power being reflected).

In connection with the description to this point reference has been made to the use of two layers including dipoles D1 and D2. In order to provide broadband absorption over a full frequency range such as from 2 to 18 GHz, several different layers of different length needles or dipoles may be employed. In this regard, reference is made hereinafter to FIG. 9 which shows a reflectivity curve for one embodiment of the present invention in which two layers are employed.

Reference has been made hereinbefore to the use of dressmaker's pins or needles for forming the dipoles D1 and D2. This technique has been used in some of the early testing of the concepts of the invention, but in accordance with the invention, it is preferred to form the dipoles as conductive layers employing silk screen and transfer methods. This is particularly advantageous because then one can easily control the resistive loading of the antenna element by using resistively loaded inks. Resistive loading has been used with different inks with different degrees of resistive loading such as 0.04, 0.25, 0.52, and 1.5 ohms/square. In one experiment, the optimum bandwidth for a single layer of 0.060 inch wide dipoles printed on a dielectric layer and spaced to 0.30 inch apart (0.6 inch length dipole strip resonant at 10 GHz) occurs when the ink is about 0.25 ohms/square.

Reference has been made hereinbefore to the use of dipoles as the antenna elements of the array. However, an even more preferred arrangement may be the spiral configuration of antenna elements as indicated at 20 in FIG. 4. Once again, different size spiral antenna elements may be employed to provide the broadband concepts as illustrated in FIG. 1 herein. The spiral configuration is particularly desired because it is polarization insensitive which is a desired characteristic of the absorber. This configuration is also intrinsically broad band due to its frequency independent properties.

Figure 5A:
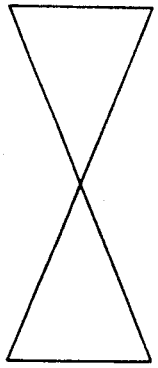
FIGS. 5A–5D illustrate other forms of antenna elements that may be employed in accordance with the principles of the present invention.
Figure 5B:
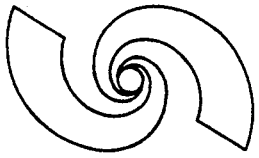
Figure 5C:
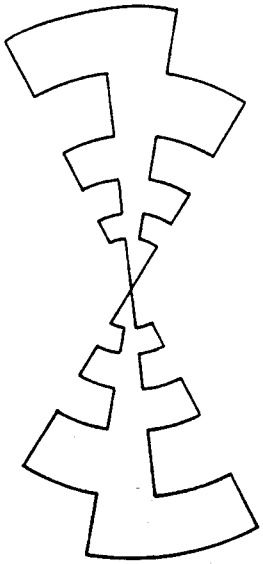
Figure 5D:
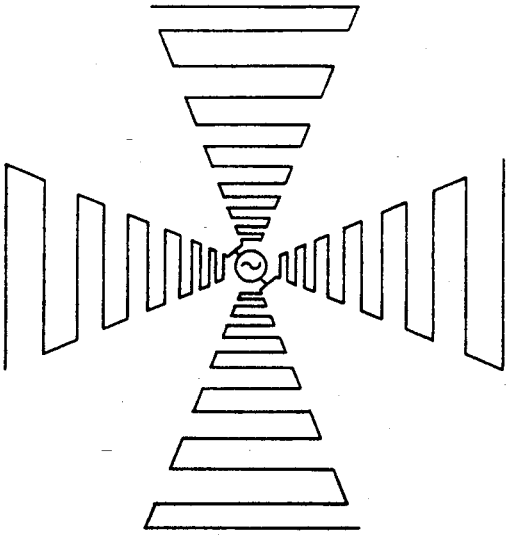

Other forms of antenna elements are described in FIGS. 5A–5D. FIG. 5A illustrates a bi-conical antenna element. FIG. 5B illustrates a spiral-type antenna element. FIG. 5C illustrates a logarithmically periodic antenna element. FIG. 5D illustrates a circularly polarized logarithmically periodic antenna element. The antenna element of FIG. 5D belongs to a class of frequency independent antennas. Frequency independent antennas may be broadly characterized as either log periodic antenna elements or spiral antenna elements. Both of these have the characteristic of being frequency independent so as to provide polarization insensitivity.

Reference has been made hereinbefore to the concepts of resistively loading the antenna elements. In this regard, reference has been made to FIG. 7 that illustrates that with the proper amount of resistive loading, proper absorption occurs, not just at a one-half wavelength spacing, but at a preferred smaller spacing on the order of less than one-tenth wavelength. It has been mentioned previously that the resistive loading can be carried out by means of silk screen deposition of resistive inks. In this case the feed gap of the antenna may be open-circuited or short-circuited. The resistive loading can also be carried out by means of providing a resistor between the terminals of the antenna (highly conductive), such as the resistor 22 associated with the spiral antenna element 24 illustrated in FIG. 6. The resistor 22 interconnects the two innermost terminals of the spiral 24. In an array of spirals, there are thus resistors 22 associated with each of the individual spiral elements.

There has been described herein the use of resistors such as the resistor 22 in FIG. 6 for providing resistive loading. In place of a resistor or in conjunction therewith one may also employ a reactive impedance such as an inductance or capacitance.

Figure 8:
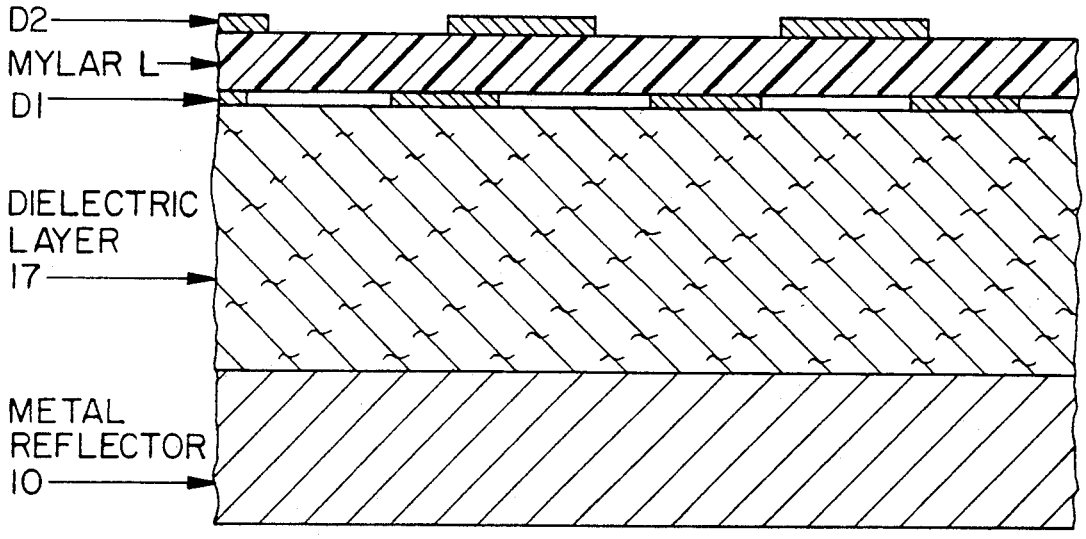
FIG. 8 illustrates an alternate form of absorber.
Figure 9:
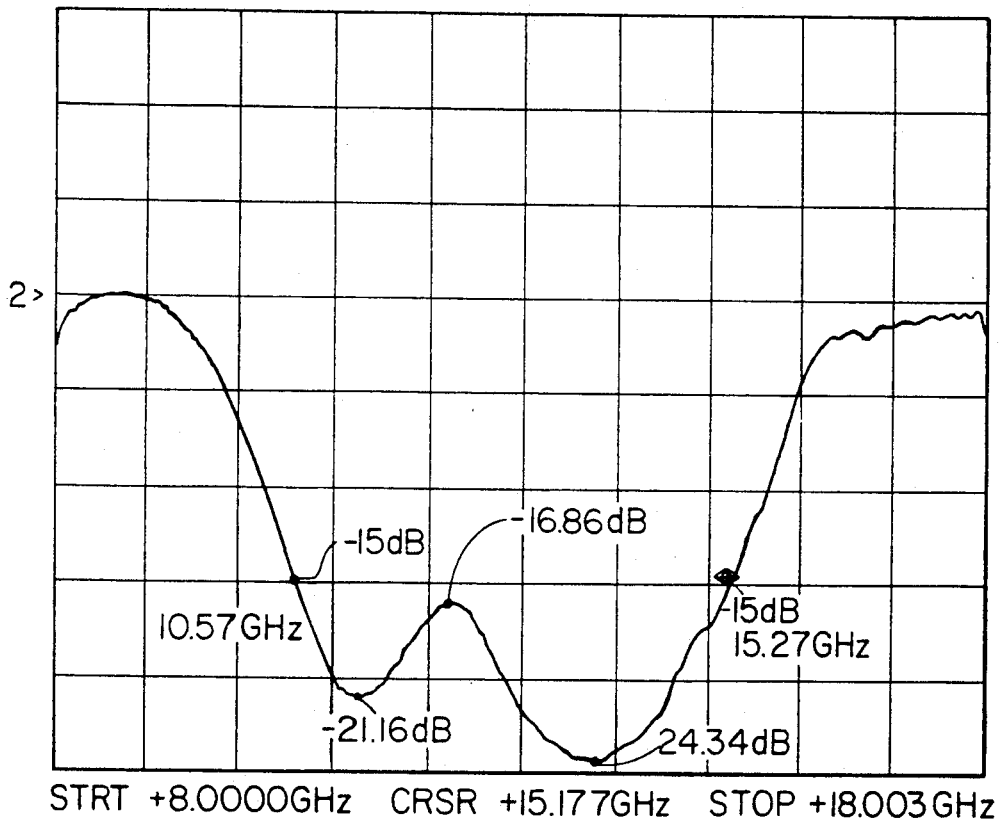
FIG. 9 is a diagram in the form of a frequency response showing a reflectivity curve in particular for a multiple layer absorber such as illustrated in FIG. 8.

Reference is now made to FIG. 8 and the associated reflectivity curve of FIG. 9. In FIG. 8 there is shown the metal reflector 10 and a single mylar strip or layer L for supporting on either side thereof, antenna elements in the form of dipoles D1 and D2, respectively. Each of these dipoles may be formed by depositing by silk screening and transfer methods a resistive ink that will form each of the individual dipoles. The resistive ink automatically provides the desired resistive loading.

FIG. 8 also shows the intermediate layer at 17 which may be a cardboard or other dielectric layer or may even be air. In this particular embodiment, the thickness of the layer 17 is 0.180 inch and the thickness of the mylar is 0.030 inch. The layer comprised of dipoles D1 is designed for resonance at 11.52 GHz. The layer comprised of dipoles D2 is designed for resonance at 13.8 GHz. FIG. 9 shows the resultant reflectivity curve in which it is noted that resonant peaks occur at approximately 11.52 GHz and 13.8 GHz. The −15 dB bandwidth extends from approximately 10.57 GHz to 15. 27 GHz. As other layers of antenna elements are added, each at a different resonance, and thus each of a different size, then the bandwidth expands. With the proper number of layers, the full bandwidth can be covered such as from 2 to 18 GHz.

Figure 12:
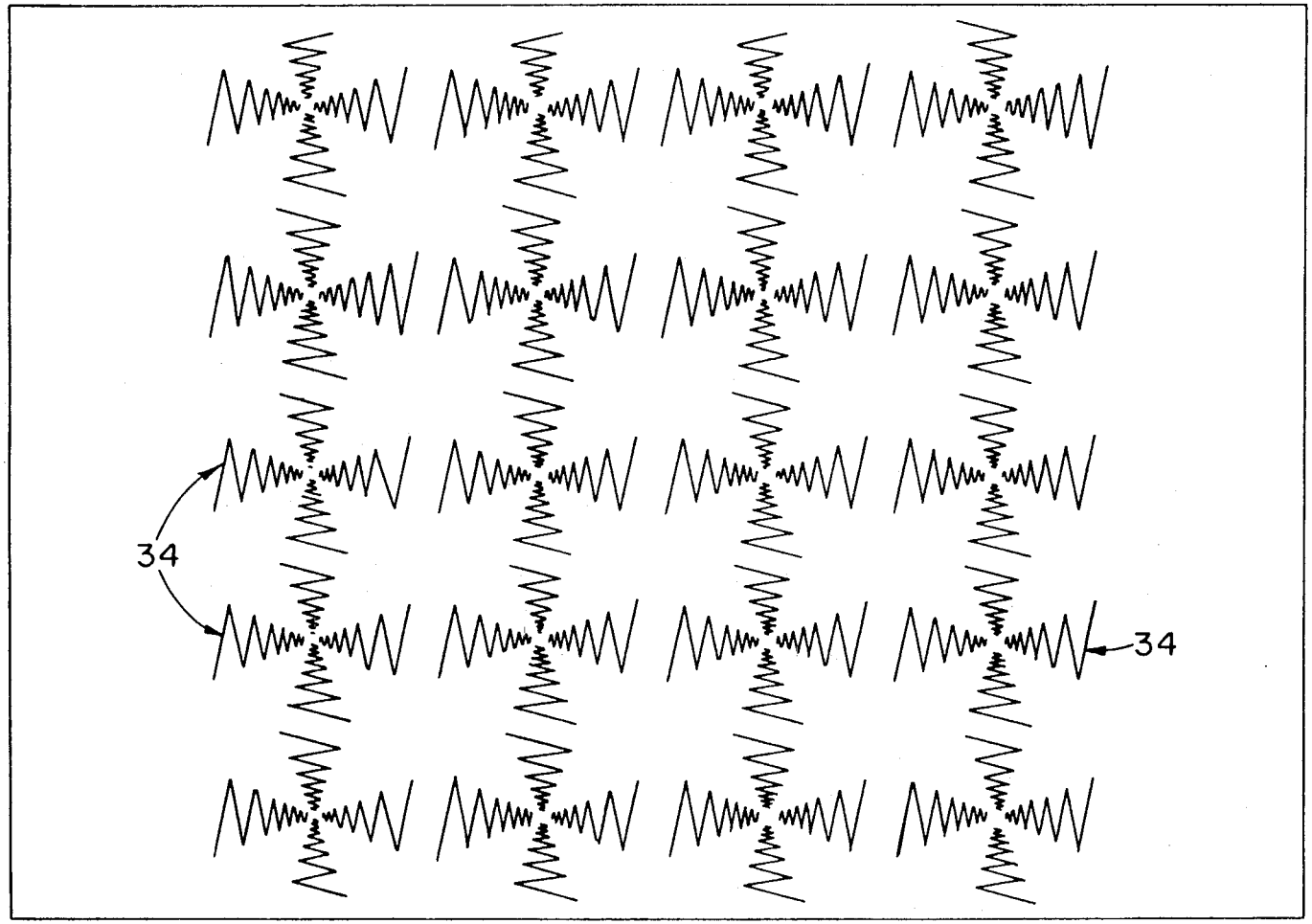
FIG. 12 illustrates a regular zig-zag antenna array pattern.
Figure 13:
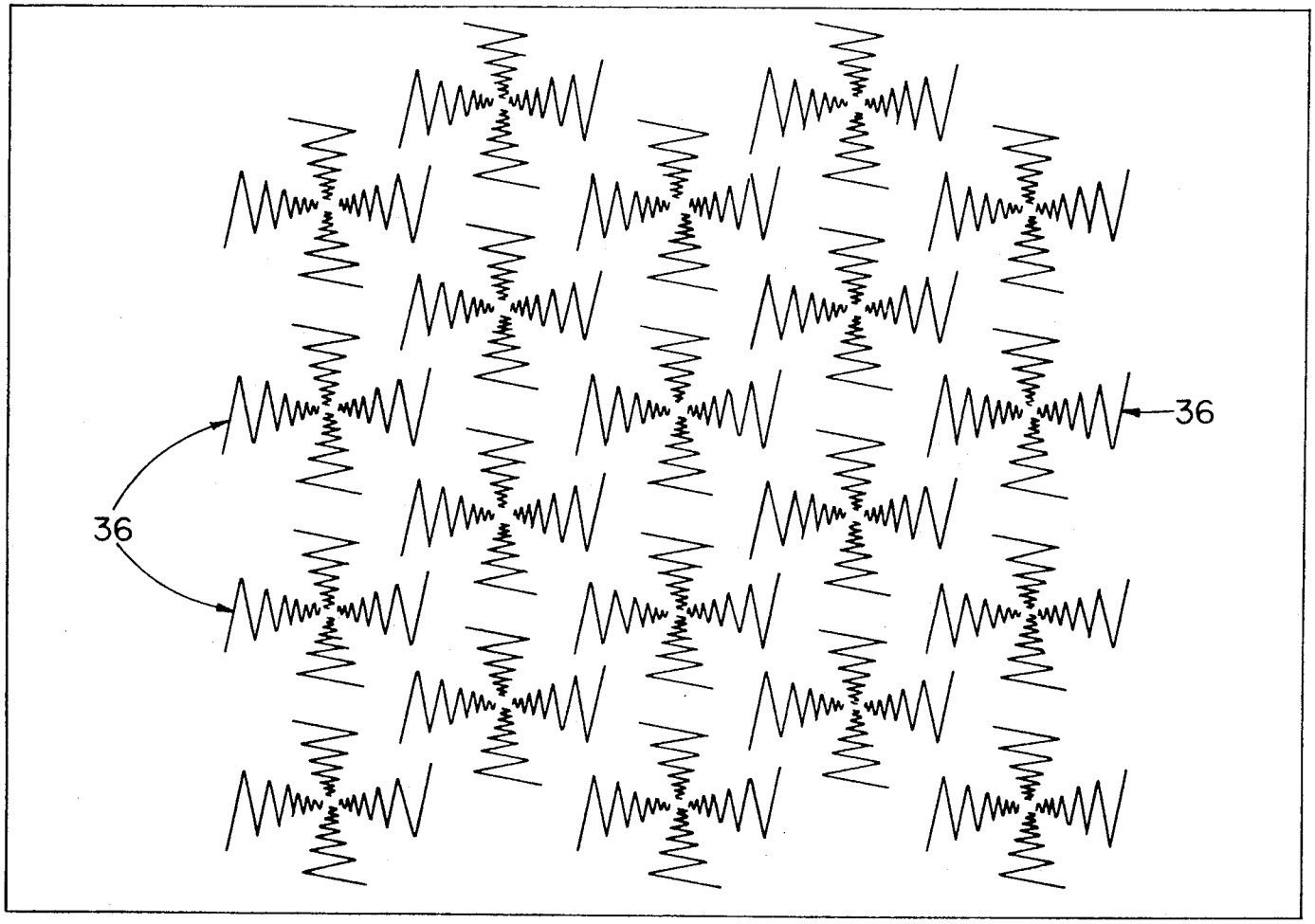
FIG. 13 illustrates a staggered zig-zag antenna array pattern.
Figure 14:
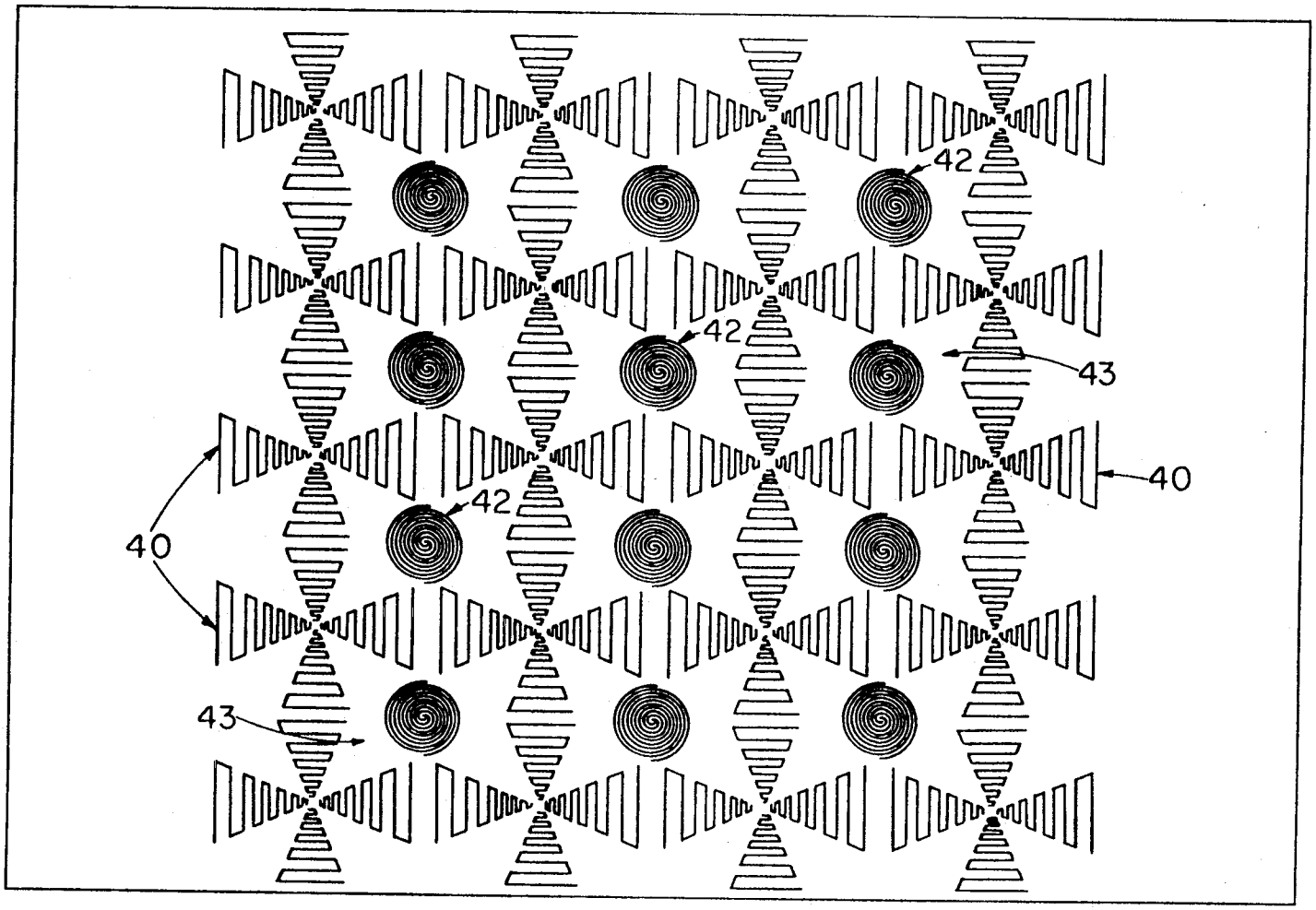
FIG. 14 illustrates an antenna array pattern comprised of trapezoidal elements and spiral elements.
Figure 15:
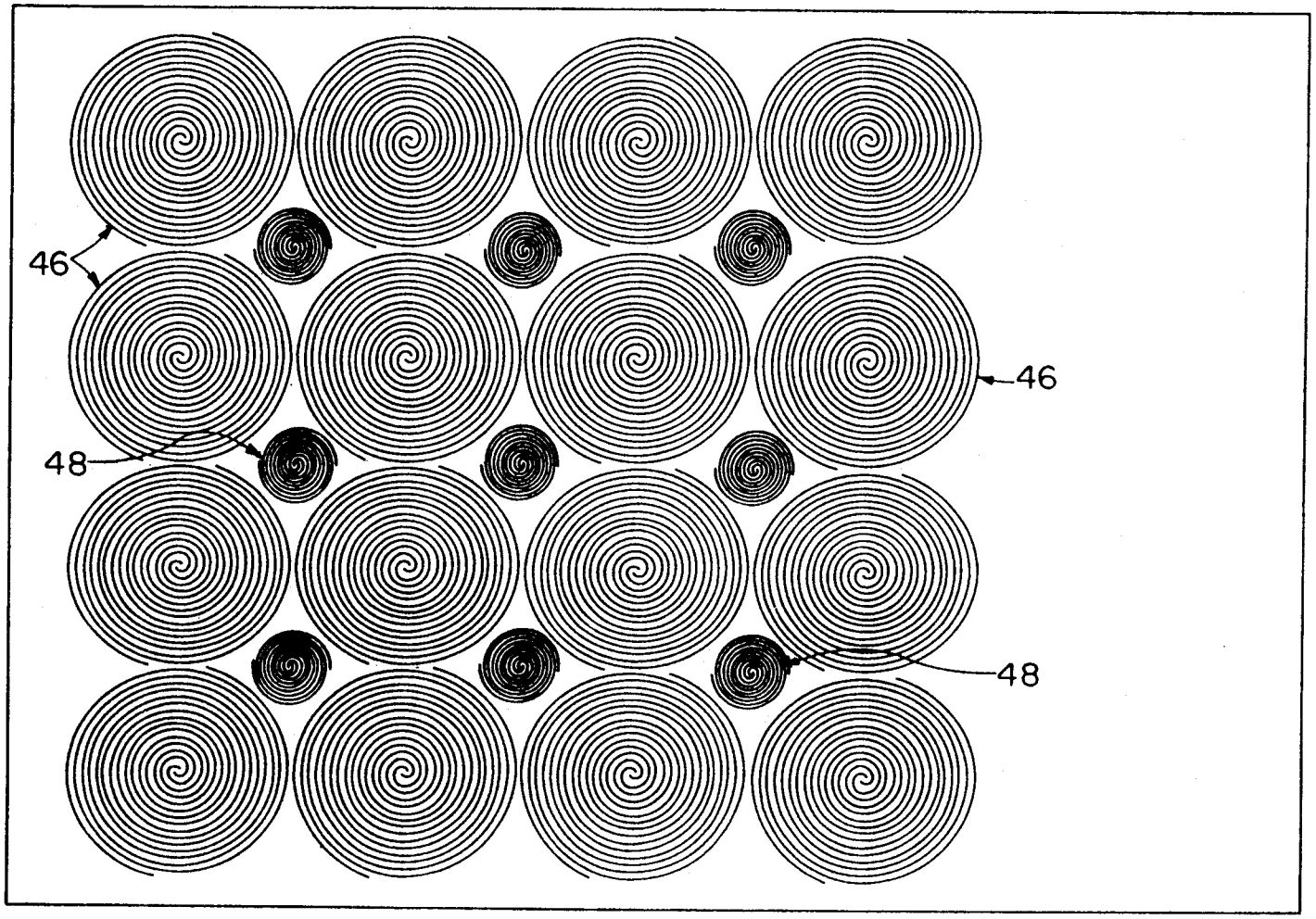
FIG. 15 illustrates an antenna array pattern comprised of large and small spiral antenna elements.
Figure 16:
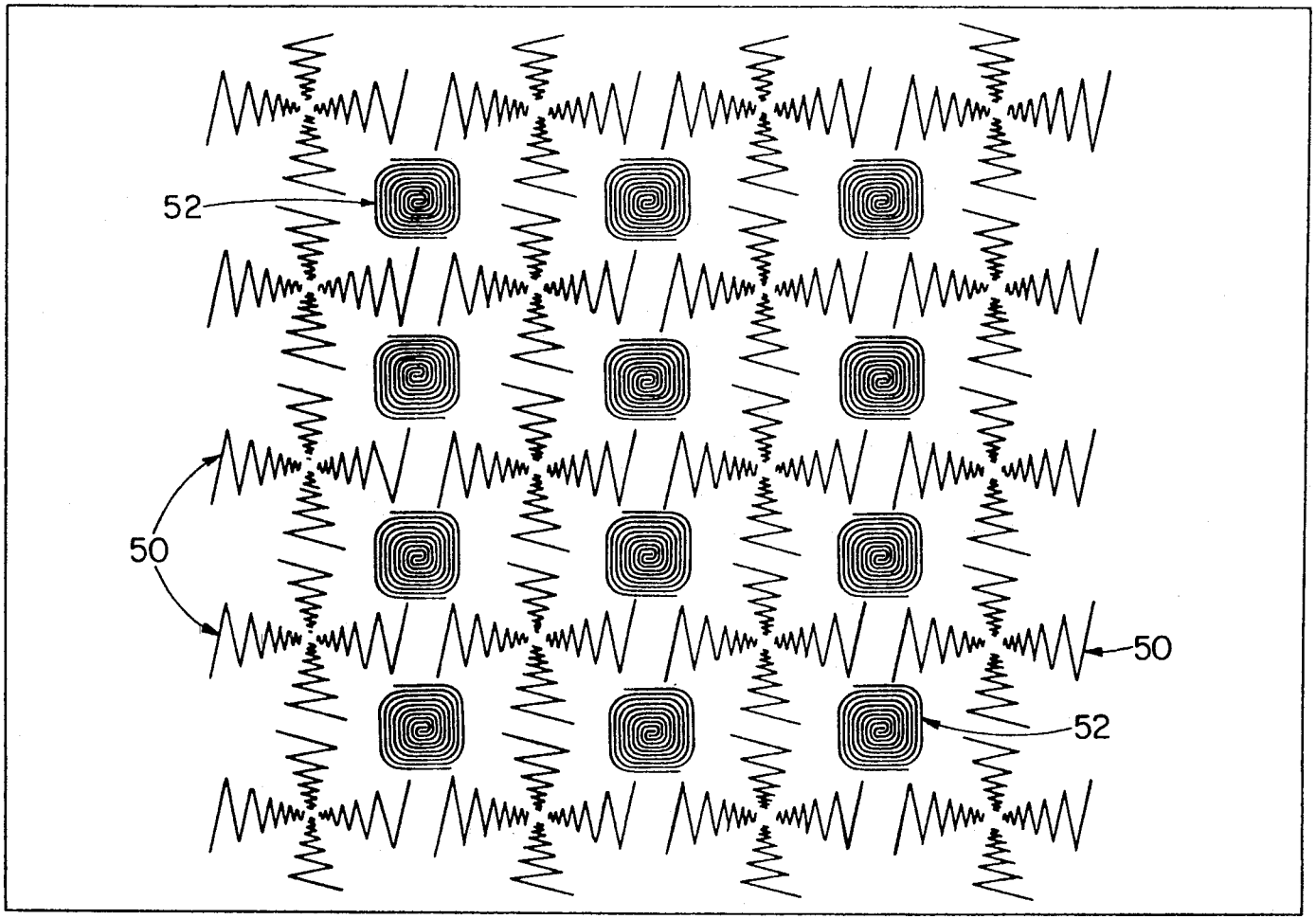
FIG. 16 illustrates an antenna array pattern comprising zig-zag elements and square-shaped spiral elements.

Reference is now made to FIGS. 10–16 for an illustration of other embodiments of antenna array patterns. FIGS. 10–13 illustrate patterns employing a single type of antenna construction. FIGS. 14–16 illustrate the concepts of the present invention in which broadbanding may be carried out in a single layer by virtue of employing different size and/or different configuration antenna elements in a single planar array.

Figure 10:
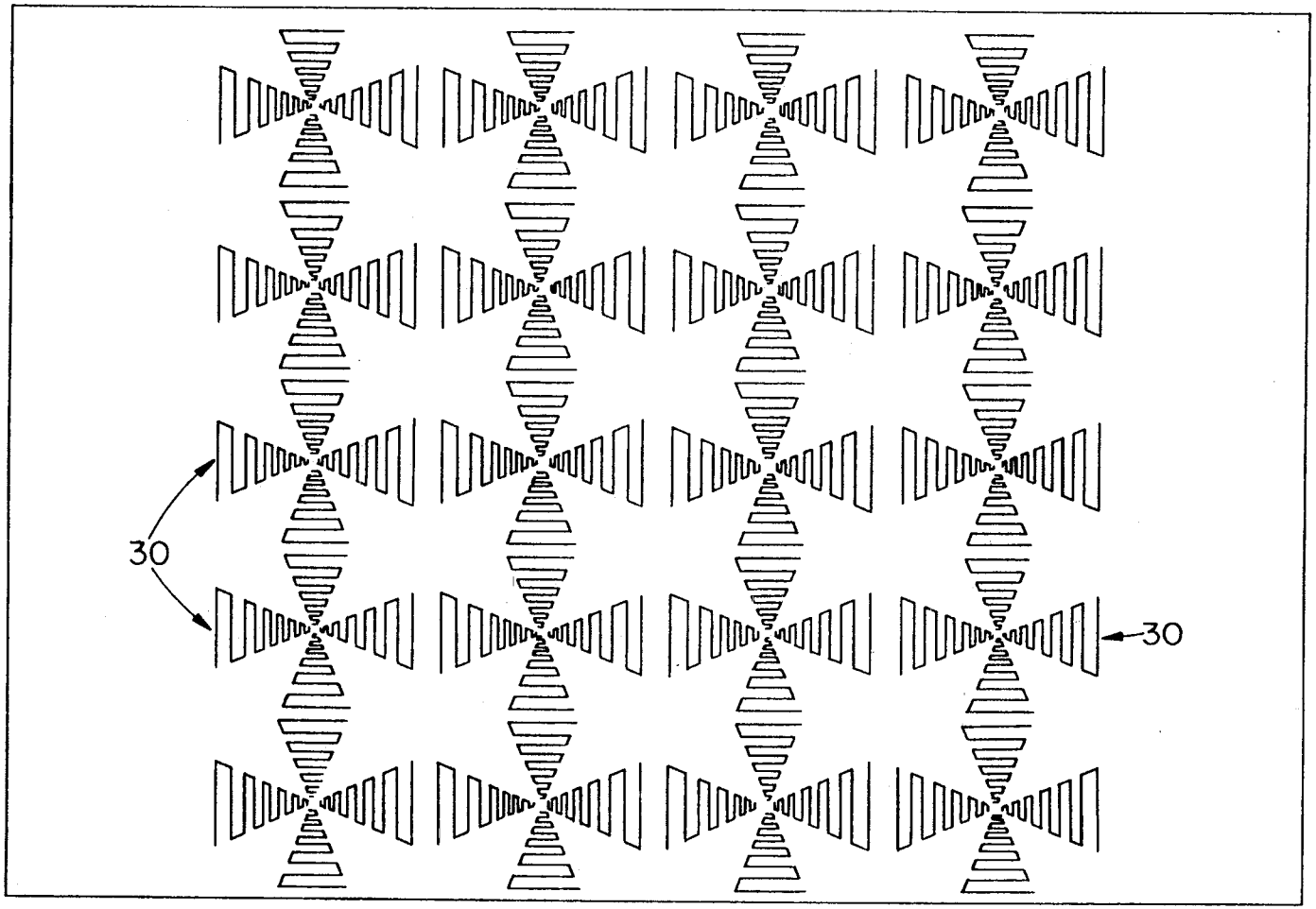
FIG. 10 illustrates a regular trapezoid antenna array pattern.
Figure 11:
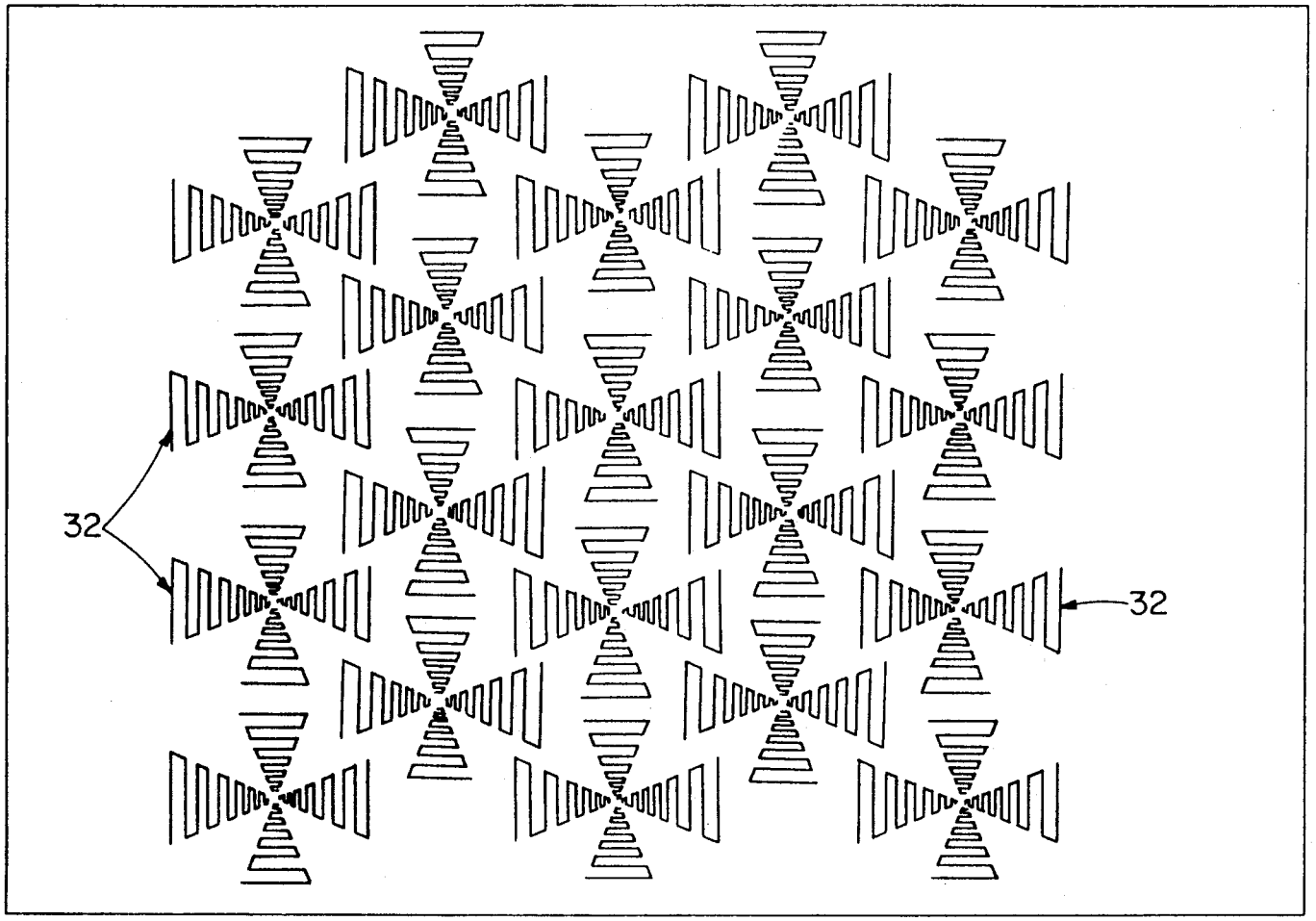
FIG. 11 illustrates an offset trapezoid antenna array pattern.

The antenna array pattern of FIG. 10 is comprised of trapezoidal antenna elements 30 disposed in a regular array. Although this form of an array is effective in providing good signal absorption, improved coverage is obtained by a configuration as illustrated in FIG. 11. FIG. 11 illustrates antenna elements 32 that are also trapezoidal elements, but that are in a staggered or offset configuration. This provides for a greater number of elements per given area.

FIG. 12 shows a zig-zag antenna array comprised of a plurality of zig-zag antenna elements 34. These elements 34 are disposed in a regular array. Again, to provide greater coverage of elements per area, a staggered array may be provided such as illustrated in FIG. 13. FIG. 13 shows a plurality of zig-zag antenna elements 36 disposed in a staggered or offset manner.

FIG. 14 also depicts a regular array of trapezoidal antenna elements 40. The trapezoidal antenna elements are interspersed by a further array of spiral antenna elements 42. The spiral antenna elements 42 are interspersed in the open area defined between four of the trapezoidal antenna elements 40.

In FIG. 14 it is noted that the spiral antenna elements 42 are relatively small in configuration. This means that for a given spacing of the antenna array from the reflector, the spiral elements will be tuned to a different frequency than the other antenna elements 40. There is thus provided tuning at different frequencies in a single layer. This provides bandwidth enhancement in a single layer configuration. Of course, the embodiments described hereinbefore in connection with multi-layering for broadband enhancement may also be employed in association with the single layer enhancement. For example, the configurations as illustrated in FIG. 14 may be provided in different layers with each layer having the antenna elements of different size. This will provide still further bandwidth enhancement.

Reference is now made to FIG. 15 which is still a further embodiment of the present invention employing broadband enhancement in a single layer. The configuration of FIG. 15 includes interspersed spiral antenna patterns including a large pattern comprised of spiral antenna elements 46 and a small pattern comprised of small spiral antenna elements 48. Again, each of the different spirals are essentially tuned to a different frequency and provide some degree of absorption at these different frequencies. Thus, a configuration such as illustrated in FIG. 15 might provide the type of frequency response as illustrated previously in connection with FIG. 9. Again, however, this is provided a single layer rather than multiple layers, although, the concepts illustrated in FIG. 15 may also be expanded to multiple layers to provide further broadband enhancement.

FIG. 16 illustrates a regular array of zig-zag antenna elements 50 and associated square-shaped spiral antenna elements 52. The configuration of FIG. 16 provides results similar to that provided in configurations of FIG. 14 and 15.

The particular configuration of FIG. 15 is one of the preferred configurations in that the two separate arrays can be made quite compact. Also, the spiral antenna element is in particular, polarization insensitive which is also a further advantage.

Figure 17:
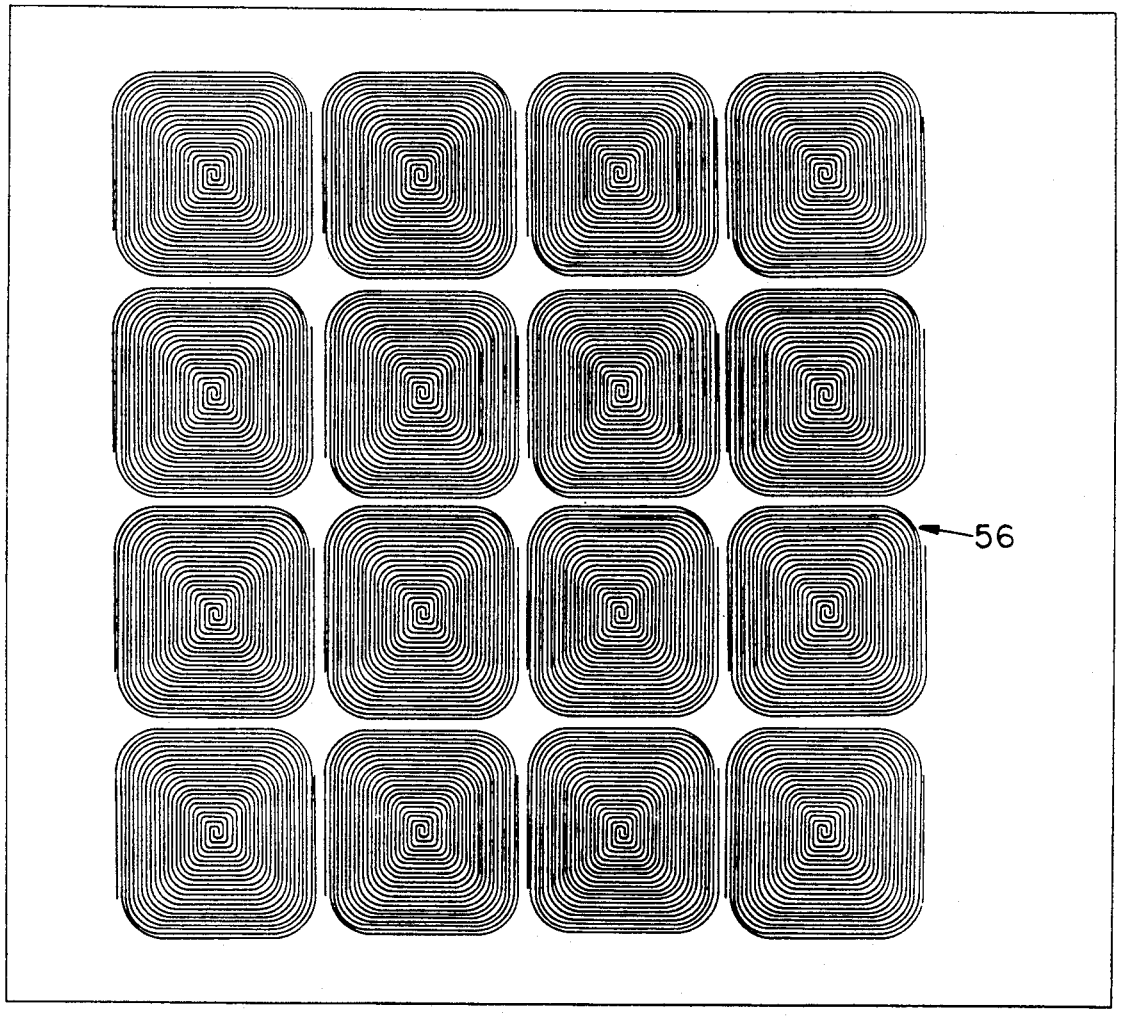
FIG. 17 illustrates an antenna pattern comprising only square-shaped spiral elements.

FIG. 17 illustrates an array of antenna elements that are in the form of square spirals as illustrated at 56. These elements are also frequency independent antenna structures.

Figure 18:
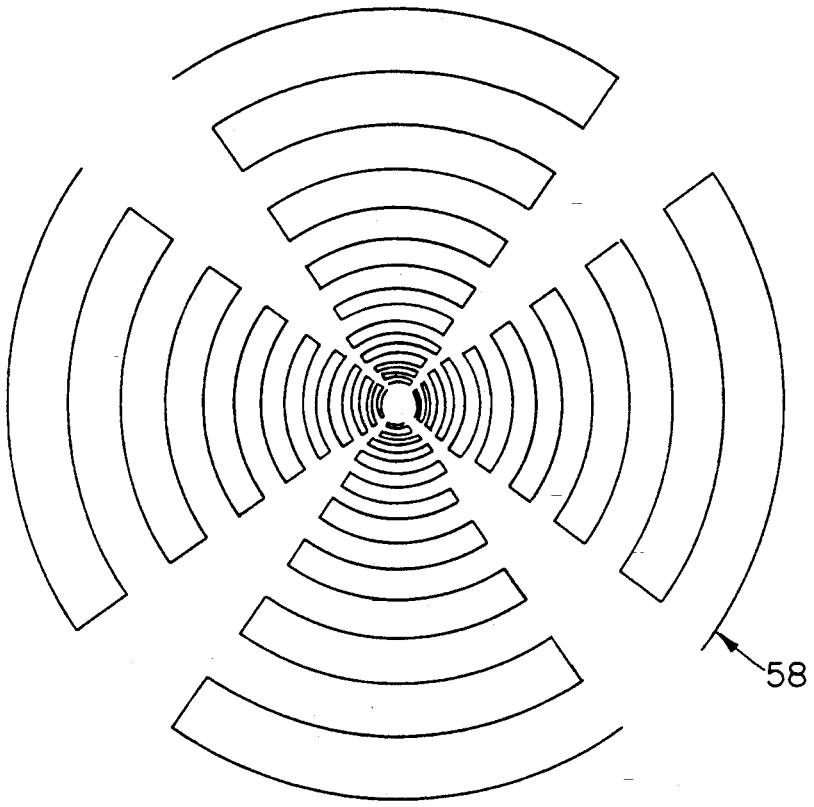
FIG. 18 illustrates an antenna array element comprising circular tooth log-periodic structure.

FIG. 18 illustrates at 58 a still version of an antenna element. This version is in the form of a circular tooth log-periodic element.

Figure 19:
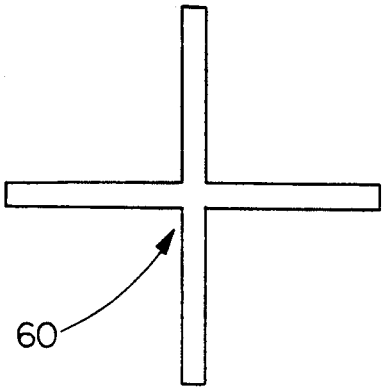
FIG. 19 illustrates a crossed dipole pattern for the antenna element.
Figure 20:
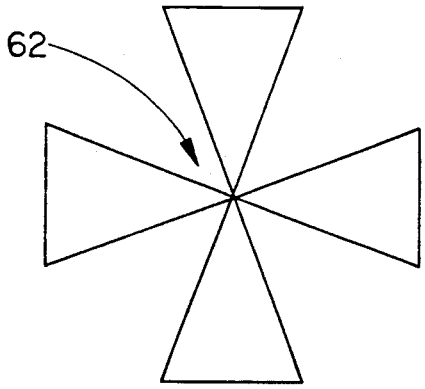
FIG. 20 illustrates a crossed bicone for the antenna element.

FIGS. 19 and 20 show further versions of the present invention. In FIG. 19 there is shown a crossed dipole antenna element 60 and in FIG. 20 there is shown a crossed bicone antenna element 62. Both of these elements provide circular polarization performance.

Although the concepts of the present invention have been described as used in a thin, flexible dielectric system, these concepts may also be employed in a rigid system. For example, these concepts may be employed in high temperature applications of several hundred degrees celsius or higher. Such materials comprising the dielectric portion of the system include ceramic materials such as cobalt oxide, vanadium dioxide or rhenium trioxide, or ceramic composite materials such as silica fiber reinforce ceramic composites, or boro-silicate glass reinforced with silicon carbide fibers (ceramic matrix). In these high temperature applications the antenna patterns are also formed by high temperature resistant inks. Also, any bonding agents have to be compatible with high temperature applications. The ceramic layers may be doped to control electrical properties.

Figure 21:
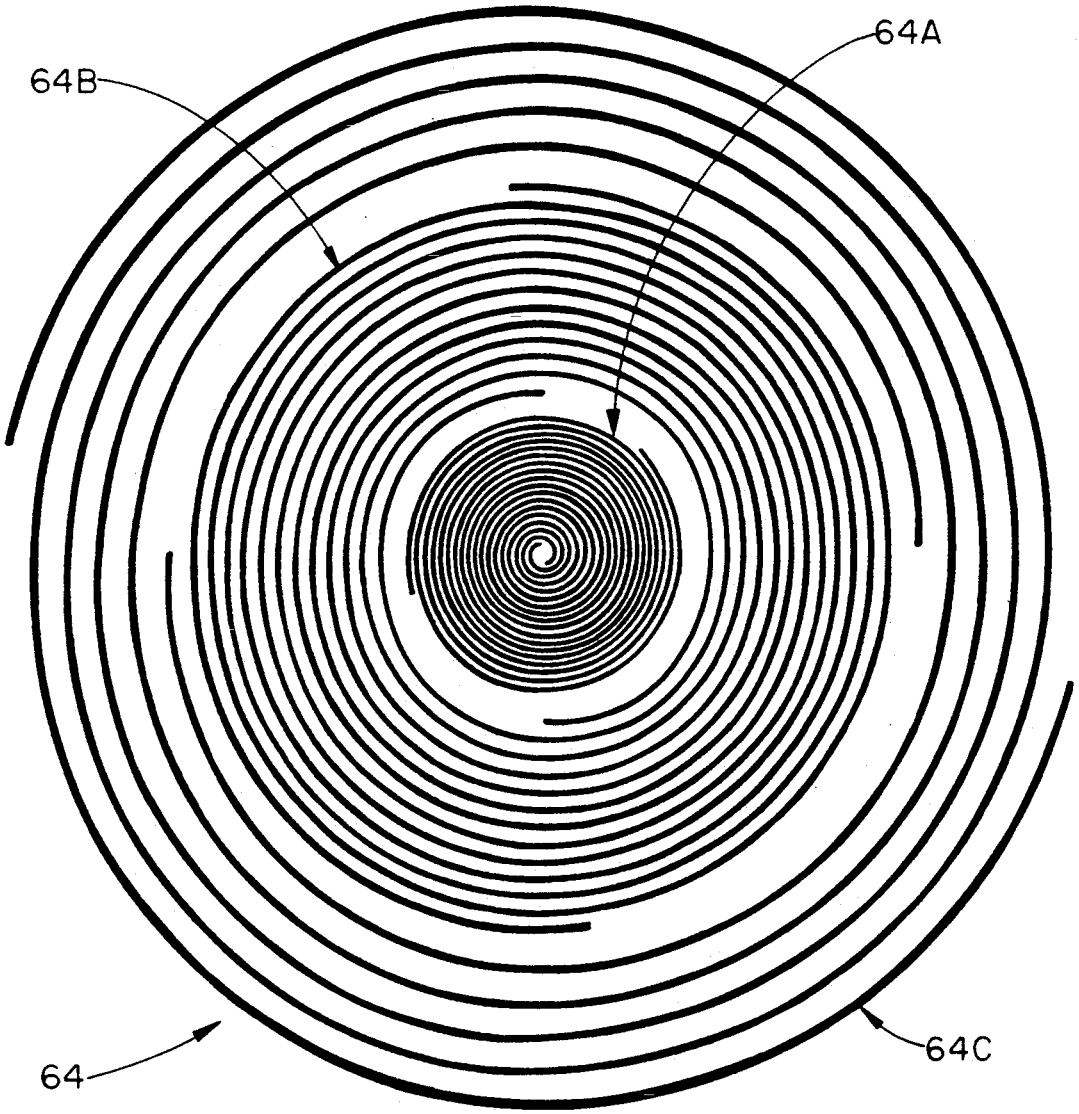
FIG. 21 illustrates an alternate spiral configuration for the antenna pattern employing three separate spirals of varying spiral turn spacing.

Reference is now made to FIGS. 21–27 for additional antenna patterns that have been found to, in particular, provide substantial improvement in broadband operation. More particularly, FIG. 21 describes a spiral antenna pattern 64 that is comprised of three separate spirals 64A, 64B, and 64C. It is noted that each of the spirals are separate and not interconnected. Furthermore, each of the spirals are of different turn spacing. The spiral 64A is most tightly wound, the spiral 64B is less tightly wound while the other spiral 64C is the most loosely coupled with the widest spacing between turns. Each of the different spirals are essentially tuned to a different frequency and thus provide some degree of absorption at these different frequencies. This thus allows for broadbanding in a single antenna array layer. FIG. 21 shows only a single pattern, however, there would be several of these spiral configurations in the overall absorber construction. The spirals may be, for example, in an array as the one previously illustrated in FIG. 15.

Figure 22:
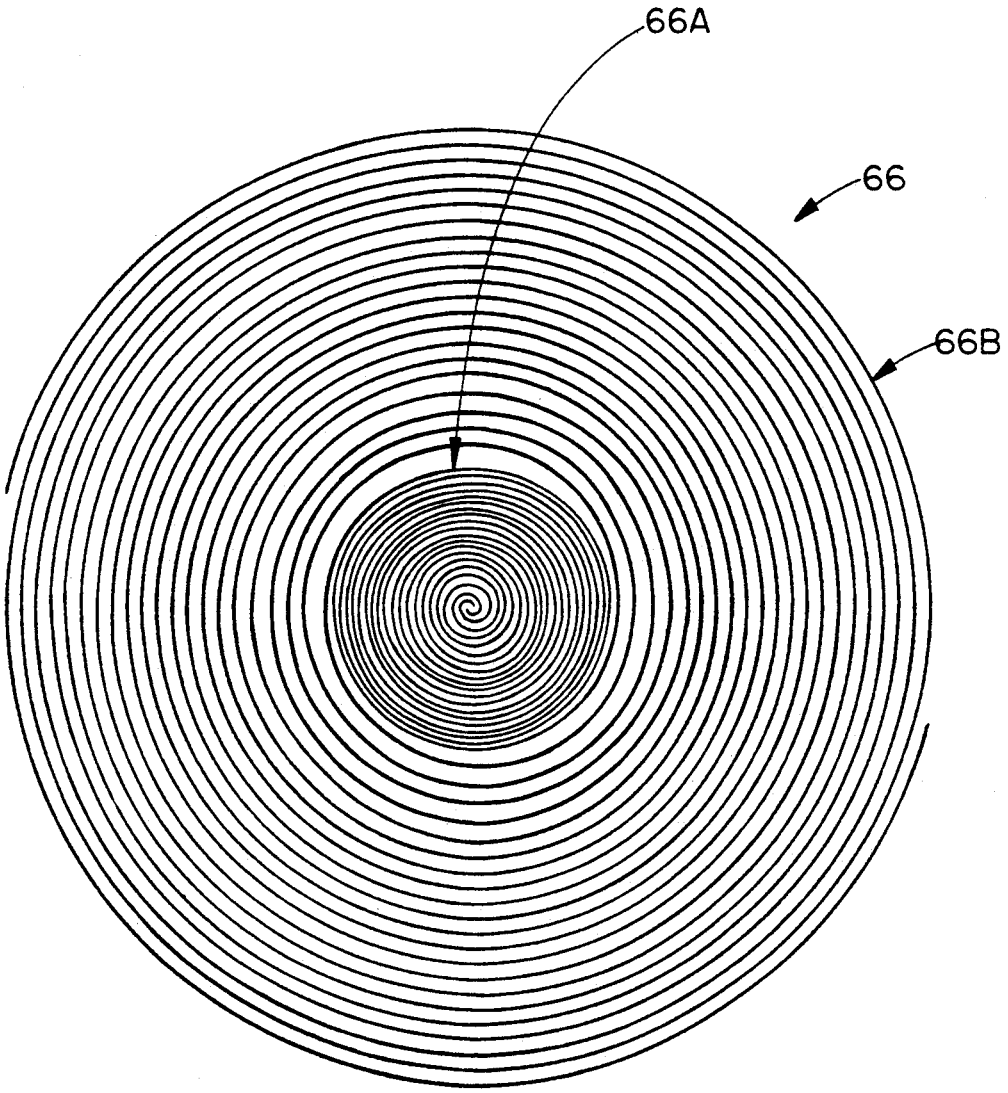
FIG. 22 illustrates a further spiral antenna pattern showing two different spacing spirals continuously connected.

Reference is now made to FIG. 22 for a further spiral antenna pattern. This particular spiral antenna pattern is comprised of two separate spiral segments, including a smaller more tightly wound spiral 66A at the center and a more loosely wound outer spiral 66B disposed thereabout. It is noted in this particular embodiment that the spirals 66A and 66B are interconnected so that the spiral turns are continuous from one spiral to the other. The spiral antenna pattern of FIG. 22 also provides improved broadband operation.

Figure 23:
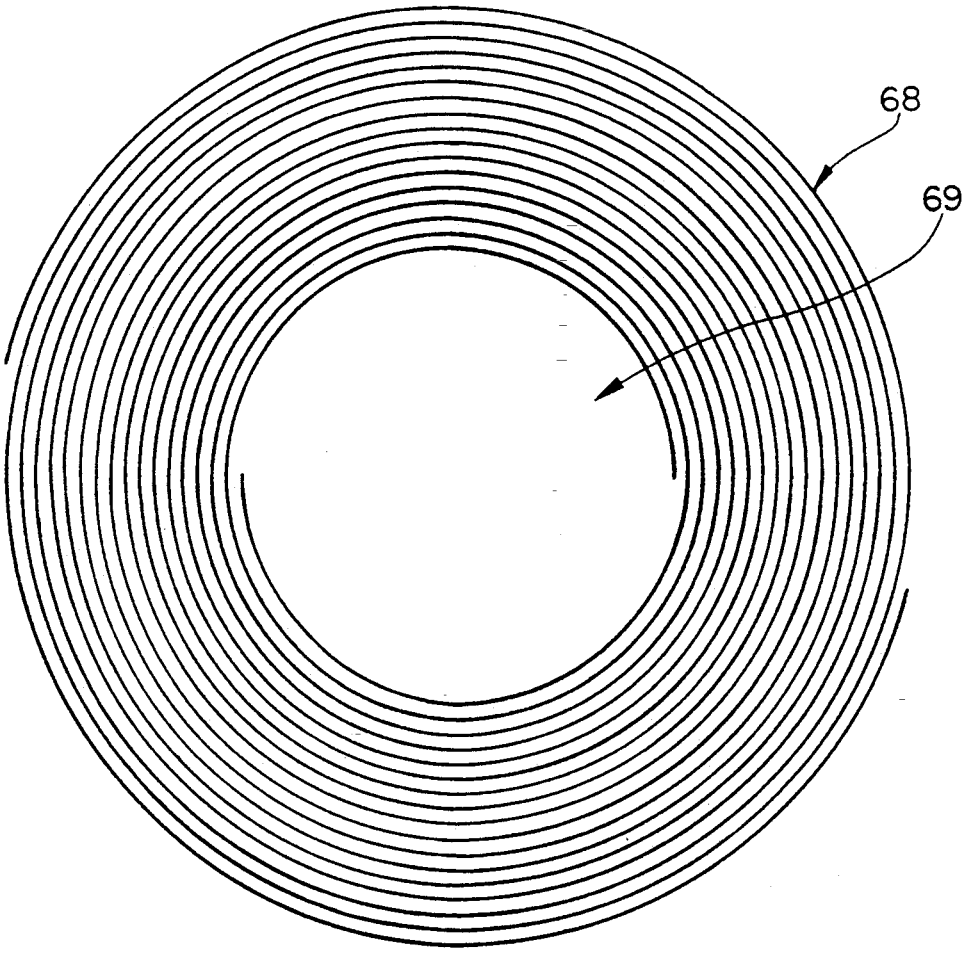
FIG. 23 illustrates a further spiral antenna pattern having an open center area.

FIG. 23 shows a further spiral antenna pattern similar to that described hereinbefore in FIG. 4. FIG. 23 shows the spiral antenna 68. However, in the embodiment of FIG. 23 the spiral is provided with an open hole or void area as illustrated at 69 in FIG. 23.

In connection with all of the spiral antenna patterns of FIGS. 21–23, these patterns are formed by, for example, a silk screening technique. The overall material thickness is made small by printing the antenna patterns, preferably using either a resistive ink in which the loading is substantially uniform throughout the pattern or a highly conductive ink in combination with a discrete resistive load.

Figure 24:
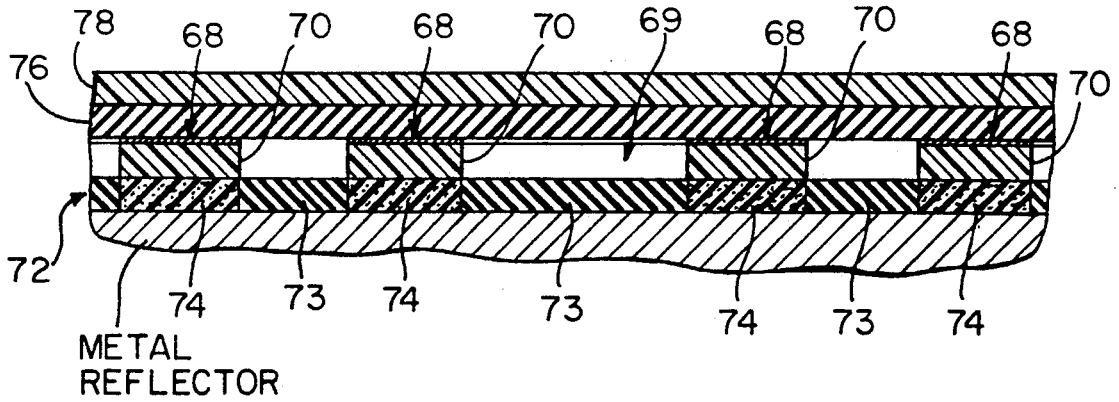
FIG. 24 is a cross-sectional view through an entire absorber construction employing the spiral antenna pattern of FIG. 23 and illustrating the additional layers of the absorber.

Now, refer to FIG. 24 for an illustration of a fragmentary cross-sectional view of an absorber employing the spiral antenna pattern of FIG. 23. Thus, in FIG. 24 there is shown the spiral antenna pattern 68 as well as a hole or void space 69. The antenna pattern 68 is disposed on a mylar layer 70. Holes are provided in this layer in the central portion of the spiral as indicated at 69 in FIG. 24. The layer 60 is disposed over a substrate layer 72 that is actually formed of different substrate sections including a main silicone layer 73 and annular sections 74.

The particular absorber construction as shown in the cross-sectional view of FIG. 24 is characterized by the provision for the layer section 74 being of a relatively high dielectric constant. A material that has been used is a silicone rubber loaded with titanium dioxide. Titanium dioxide has a very high dielectric constant. It is noted that the section 74 underlies the antenna pattern 68. This arrangement provides for a tuning of the structure, particularly to tune the band to lower frequency. Thus, by controlling the loading of the substrate underlying the antenna pattern one can therefore tune the particular frequency band to a desired band of operation.

In FIG. 24 disposed over the mylar layer 70 is rubber layer 76 and over the layer 76 there is provided a layer 78 that may be comprised of a thin plastic layer coated with a resistive coating. This resistive coating layer 78 may have a coating of 3100 ohms per square.

Figure 25:
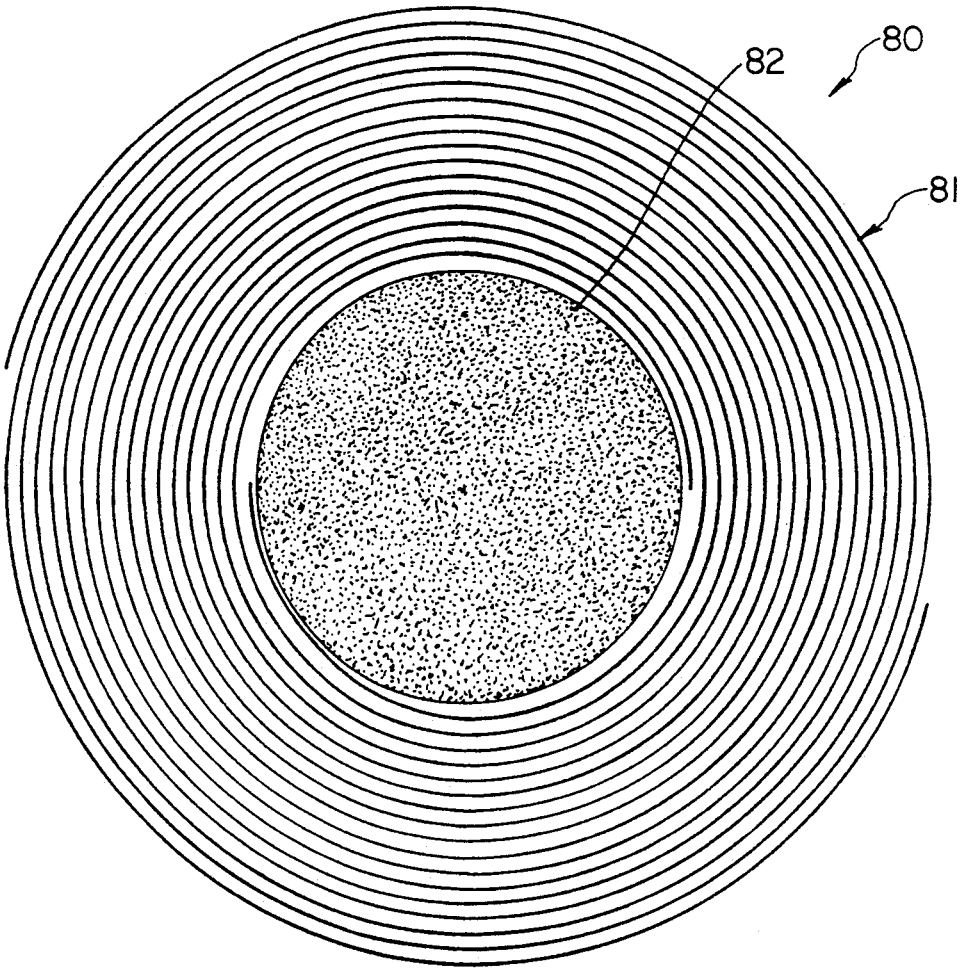
FIG. 25 illustrates a further embodiment of a spiral antenna pattern employing a centrally disposed ferrite disk.
Figure 26:
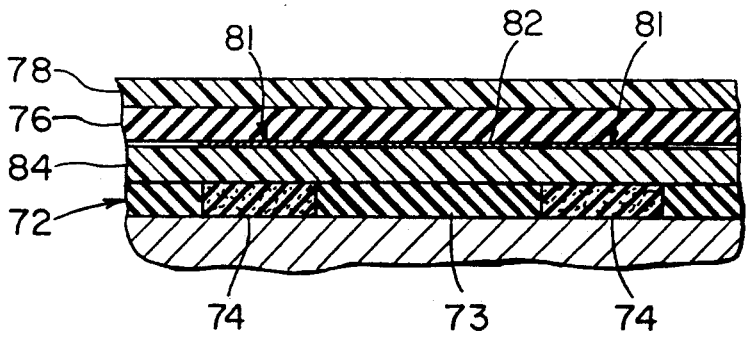
FIG. 26 is a fragmentary cross-sectional view of a complete absorber construction employing the particular spiral antenna pattern and ferrite disk of FIG. 25.

Reference is now made to FIGS. 25 and 26 for still a further embodiment of the spiral antenna pattern. In this particular configuration of antenna pattern, there is provided a pattern 81 that has an open center area filled with a ferrite disk 82. As in the embodiment illustrated in detail in FIG. 24, this embodiment of absorber employs a mylar layer 84 for support of the antenna pattern 81 as well as the deposited ferrite disk 82. The other parts of the absorber may be the same as described in FIG. 24 and thus in FIG. 26 have been identified by the same reference characters. The absorber is thus comprised of a substrate layer 72 comprised of silicone rubber and titanium dioxide loaded silicone rubber. Overlying the antenna pattern are the aforementioned layers 76 and 78.

Figure 27:
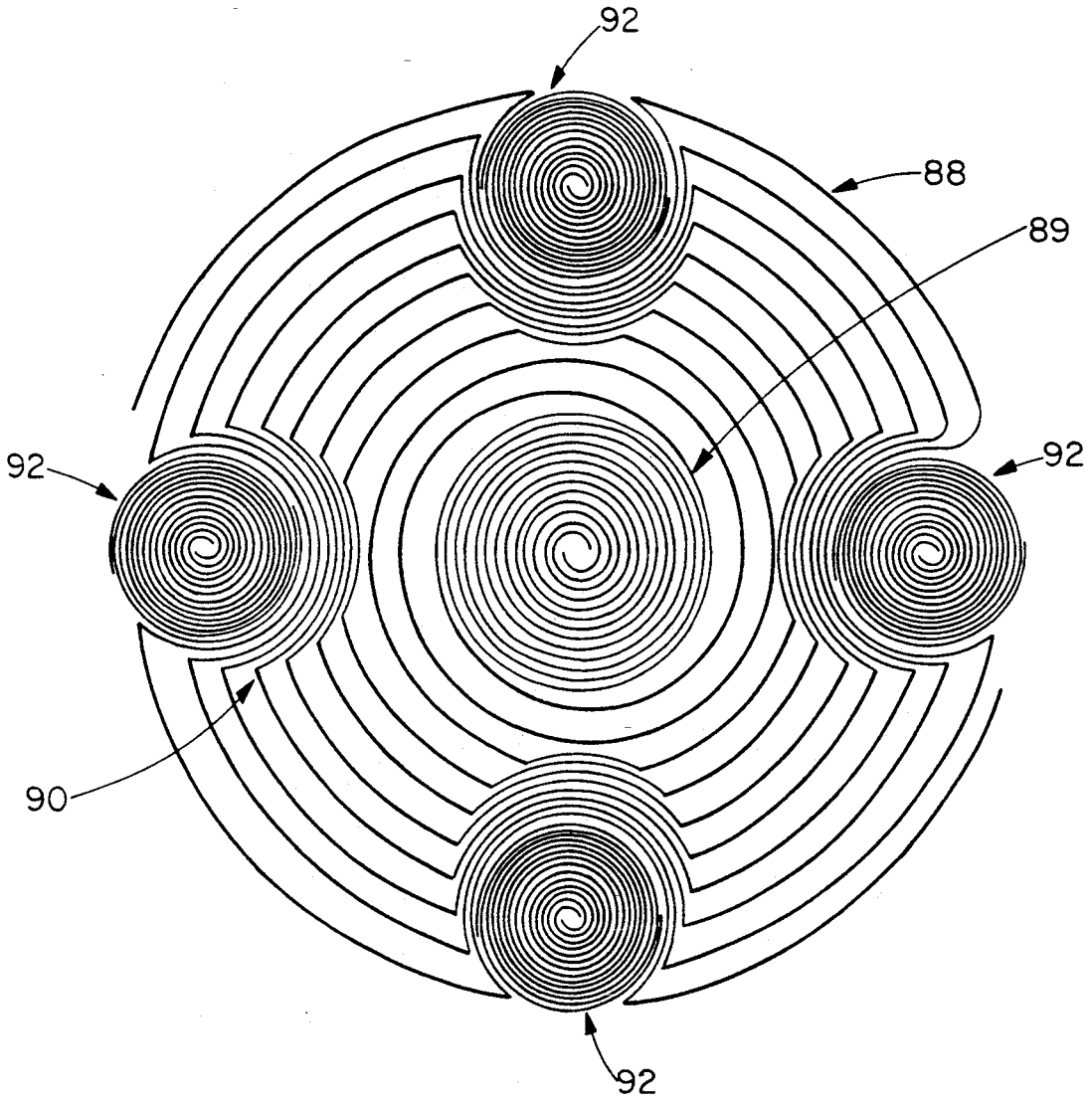
FIG. 27 shows still a further spiral antenna pattern configuration employing both continuous and separate spiral segments.

FIG. 27 shows still a further spiral antenna pattern configuration. In FIG. 27 there is provided a main spiral 88 that is contiguous with an internal smaller diameter spiral 89. At 90° intervals of the spiral 88, the turns are directed inwardly at successive loops as illustrated at 90 in FIG. 27. Within each of these loops there is provided a separate relatively closed turn spiral 92. In the particular embodiment described herein there are four of these smaller spirals 92. This configuration of spiral antenna pattern has also been found to provide improved broadband operation.

Figure 28:
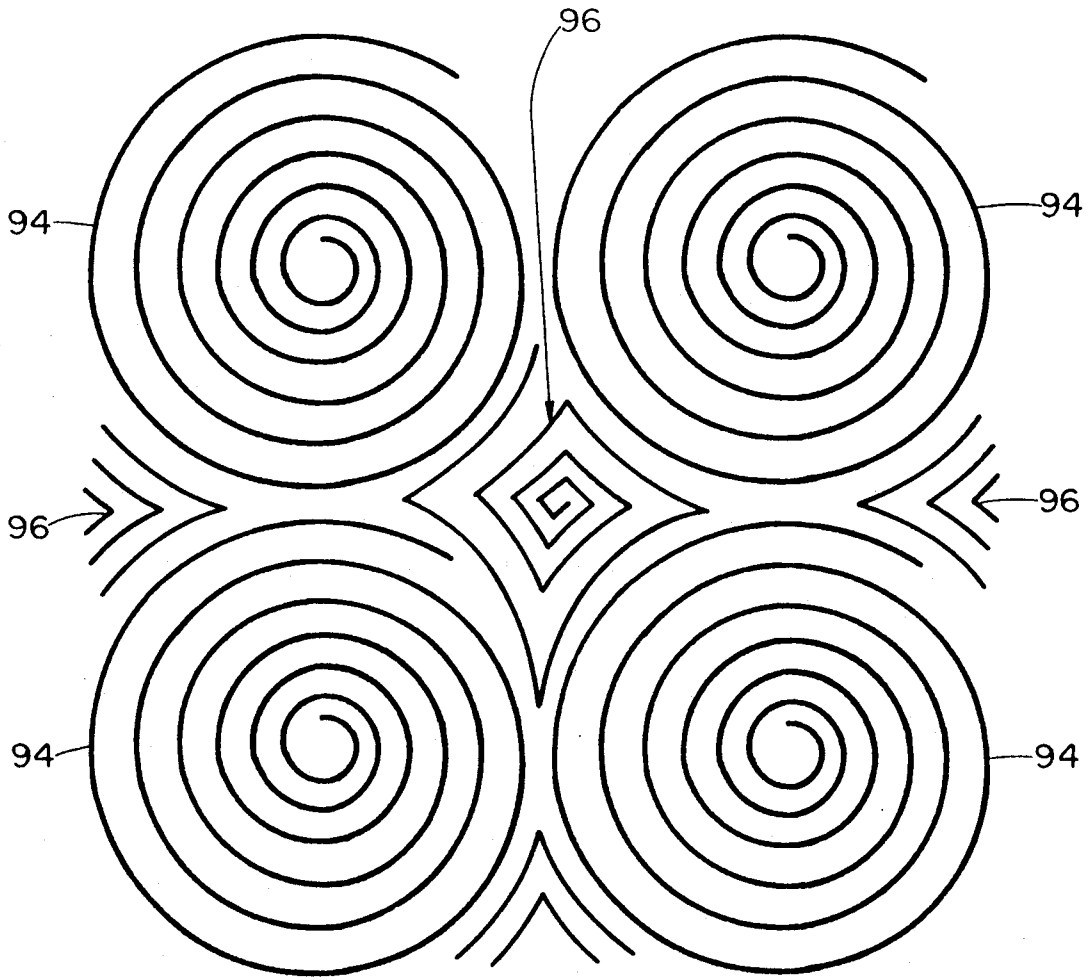
FIG. 28 shows still a further spiral antenna pattern providing good bandwidth absorption and optimizing antenna pattern coverage.

Still another embodiment of the present invention is illustrated in FIG. 28. FIG. 28 also shows a spiral antenna pattern configuration. There are provided a plurality of spiral antennas 94. In association with these spiral antenna patterns there are provided, in interstitial space between these spirals, are complimentary modified spiral pattern 96. The patterns 96 are not the usual circular spiral but are instead more of a square spiral configuration but having accurate sides illustrated in FIG. 28 basically matching the maximum diameter of the spirals 94. With this particular spiral configuration, it is noted that there is complimentary matching between the patterns so that virtually the entire surface is covered. This has been found to provide improved broadband operation.

Having now described a limited number of embodiments of the present invention, it should now be apparent to those skilled in the art that numerous other embodiments and modifications thereof are contimplated as falling within the scope of the present invention as defined by the appended claims.

What is claimed is:

1. Radar absorbing apparatus for absorbing an electromagnetic energy wave having frequency signal content in a frequency range including 2–18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, wherein said elements each comprise a spiral element.

2. Radar absorbing apparatus for absorbing an electromagnetic energy wave having frequency signal content in a frequency range including 2–18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, wherein said elements each comprise a circularly polarized element.

3. Radar absorbing apparatus as set forth in claim 2 wherein said elements each comprises a dielectric layer.

4. Radar absorbing apparatus as set forth in claim 3 wherein said dielectric layer comprises plastic.

5. Radar absorbing apparatus as set forth in claim 3 wherein said dielectric layer comprises rubber.

6. Radar absorbing apparatus as set forth in claim 2 wherein said means for resistively loading includes means for forming the elements themselves of a partially conductive resistive layer deposited on said supporting means.

7. Radar absorbing apparatus as set forth in claim 6 wherein said resistive layer has an impedance in the range of 0.04–1.50 ohms/square.

8. Radar absorbing apparatus as set forth in claim 2 wherein said means for resistively loading includes means for forming a resistor at a terminal of the element.

9. Radar absorbing apparatus as set forth in claim 2 including means for loading the means for supporting the elements to make it lossy.

10. Radar absorbing apparatus as set forth in claim 2 wherein said dielectric layer comprises a high temperature resistant layer.

11. Radar absorbing apparatus as set forth in claim 2 wherein said dielectric layer comprises a ceramic material.

12. Radar absorbing apparatus as set forth in claim 2 wherein said dielectric layer comprises a ceramic composite.

13. Radar absorbing apparatus as set forth in claim 2 wherein said elements each comprise separate spiral patterns.

14. Radar absorbing apparatus for absorbing an electromagnetic energy wave having frequency signal content in a frequency range including 2–18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, wherein said elements each comprise a bi-conical element.

15. Radar absorbing apparatus for absorbing an electromagnetic energy wave having frequency signal content in a frequency range including 2–18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, wherein said elements each comprise a logarithmically periodic element.

16. Radar absorging apparatus for absorbing an electromagnetic energy wave having frequency signal content in a frequency range including 2–18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, means for loading the means for supporting the elements to make it lossy, wherein said means for loading includes materials selected from the group of glass spheres, carbon particles, rutile, graphite, and ferrite.

17. Radar absorbing apparatus for absorbing an electromagnetic energy wave having frequency signal content in a frequency range including 2–18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, and coating means of a lossy material selected from a group including graphite and ferrite-graphite mixtures in an epoxy base.

18. Radar absorbing apparatus for absorbing an electromagnetic energy wave having frequency signal content in a frequency range including 2–18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, and a second antenna array also comprised of a plurality of discrete absorber elements, and means for supporting said second array spaced from said first array remote from said reflector means.

19. Radar absorbing apparatus as set forth in claim 18 wherein said second array is for absorbing electromagnetic energy in a different frequency band than that of the first array.

20. Radar absorbing apparatus as set forth in claim 19 wherein the elements of the first array are smaller than the elements of the second array.

21. Radar absorbing apparatus as set forth in claim 20 wherein the first array and second array both comprise dipoles with the first array dipoles shorter in length than the second array dipoles.

22. Radar absorbing apparatus for absorbing an electromagnetic energy wave having frequency signal content in a frequency range including 2-18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, wherein said elements each comprise a trapezoid configuration.

23. Radar absorbing apparatus as set forth in claim 22 wherein the elements are disposed in an offset trapezoidal configuration.

24. Radar absorbing apparatus for absorbing an electromagnetic energy wave having frequecny signal content in a frequency range including 2-18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, wherein said elements are of spiral configuration.

25. Radar absorbing apparatus for absorbing an electromagnetic energy wave having frequecny signal content in a frequency range including 2-18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, wherein said elements each comprise a zig-zag configuration.

26. Radar absorbing apparatus as set forth in claim 25 wherein the elements are disposed in an offset zig-sag configuration.

27. Radar absorbing apparatus for absorbing an electromagnetic energy wave having frequecny signal content in a frequency range including 2-18 GHz, said apparatus comprising;

an electrically conductive reflector means, a substantially planar array comprised of a plurality of discrete broadband impedance absorber elements, means for supporting said absorber elements from and in front of said electrically conductive reflector means and in at least a first planar array, means for substantially uniformly resistively loading the absorber elements therethrough to change the impedance thereof to in turn alter the gain thereof thereby decreasing signal re-radiation, said array disposed at a distance from said reflector means, wherein the elements comprised first and second different size elements.

28. Radar absorbing apparatus as set forth in claim 27 wherein the elements of first size are interspersed with the elements of second size.

29. Radar absorbing apparatus as set forth in claim 28 wherein the first and second size elements are both of spiral configuration.

30. Radar absorbing apparatus as set forth in claim 28 wherein the first size elements are trapezoidal and the second size elements are spiral.

31. Radar absorbing apparatus as set forth in claim 28 wherein the first size elements are zig-zag and the second size elements are spiral.

32. Broadband radar absorbing apparatus for absorbing an electromagnetic energy wave having frequency signal content in a frequency range including 2-18 GHz, said apparatus comprising;

an electrically conductive reflector means, a first array comprised of a plurality of discrete absorber elements, means for supporting said first array from and in front of said electrically conductive reflector means and in at least a first planar configuration, said first array adapted for absorption over a first predetermined frequency segment included in said frequency range, a second array also comprised of a plurality of discrete absorber elements, and means for supporting said second array spaced from said first array remote from said reflector means, said second array adapted for absorbing electromagnetic energy in a second frequency segment included in said frequency range.

33. Broadband radar absorbing apparatus as described in claim 32 including means for resistively loading each of the arrays.

34. Broadband radar absorbing apparatus as described in claim 33 wherein said means for resistively loading include means for forming the elements by a resistive ink deposited on said dielectric layer.

35. Broadband radar absorbing apparatus as described in claim 33 wherein each array is disposed at a distance from said reflector means on the order of one-tenth wavelength or less of the electromagnetic energy wave associated with each wave.

36. Broadband radar absorbing apparatus as described in claim 35 wherein the means for supporting the elements comprises a dielectric layer for each array.

37. Broadband radar absorbing apparatus as described in claim 36 wherein said means for resistively loading include means for forming a resistor at a terminal of the element.

38. Broadband radar absorbing apparatus as described in claim 32 wherein the elements comprises dipole elements.

39. Broadband radar absorbing apparatus as described in claim 32 wherein the elements comprises spiral elements.

40. Broadband radar absorbing apparatus as described in claim 32 wherein the elements comprises circularly polarized elements.

41. Broadband radar absorbing apparatus as described in claim 32 wherein the elements comprise biconical elements.

42. Broadband radar absorbing apparatus as described in claim 32 wherein the elements comprise logarithmically periodic antenna elements.

43. Broadband radar absorbing apparatus as described in claim 32 wherein the elements comprise first and second different size elements.

44. Broadband radar absorbing apparatus as described in claim 43 wherein the elements of first size are interspersed with the elements of second size.

45. Broadband radar absorbing apparatus as described in claim 32 wherein the elements each comprise a trapezoid configuration.

46. Broadband radar absorbing apparatus as described in claim 32 wherein the elements each comprise a zig-zag configuration.

47. Radar absorbing apparatus for absorbing an electromagnetic energy wave having frequency signal content in a frequency range including 2–18 GHz, said apparatus comprising;

an electrically conductive reflector means, a substantially planar array comprised of a plurality of discrete broadband impedance absorber element, means for supporting said absorber elements from and in front of said electrically conductive reflector means and in at least a first planar array, means for substantially uniformly resistively loading the elements therethrough, said resistive loading being in a range on the order of 0.04–2.0 ohms/square, wherein said elements comprises first and second different size elements.

48. Radar absorbing apparatus for absorbing an electromagnetic energy wave having frequency signal content in a frequency range including 2–18 GHz, said apparatus comprising;

an electrically conductive reflector means, a substantially planar array comprised of a plurality of discrete broadband impedance absorber element, means for supporting said absorber elements from and in front of said electrically conductive reflector means and in at least a first planar array, means for substantially uniformly resistively loading the elements therethrough, said resistive loading being in a range on the order of 0.04–2.0 ohms/square, including a second array also comprised of a plurality of discrete absorber elements, and means for supporting said second array spaced from said first array remote from said reflector means.

49. Radar absorbing apparatus as set forth in claim 48 wherein said second array is for absorbing electromagnetic energy in a different frequency band than that of the first array.

50. Radar absorbing apparatus as set forth in claim 48 wherein each element comprises a spiral element having an open central area.

51. Radar absorbing apparatus as set forth in claim 50 including a ferrite disk in the open center area.

52. Radar absorbing apparatus for absorbing an electromagnetic energy wave having frequency signal content in a frequency range including 2–18 GHz, said apparatus comprising;

an array comprised of a plurality of discrete absorber elements, means for supporting said array from and in front of said electrically conductive reflector means and in a planar configuration, said elements including elements of first and second different size, said first size elements adapted for absorption primarily over a first frequency segment included in said frequency range, said second size elements adapted for absorption primarily over a second frequency segment included in said frequency range.

53. Radar absorbing apparatus as set forth in claim 52 wherein said elements are polarization insensitive.

54. Radar absorbing apparatus as set forth in claim 52 wherein said elements are both of like shape.

55. Radar absorbing apparatus as set forth in claim 52 wherein said first size elements are trapezoidal and the second size elements are spiral.

56. Radar absorbing apparatus as set forth in claim 52 wherein the first size elements are zig-zag and the second size elements are spiral.

57. Radar absorbing apparatus as set forth in claim 52 wherein the first and second size elements are both of spiral configuration.

58. Radar absorbing apparatus for absorbing an electromagnetic energy wave having a frequency signal content in a frequency range including 2–18 GHz, said apparatus comprising;

an electrically conductive reflector means, an array comprised of a plurality of discrete broadband impedance absorber elements, means for supporting said absorber elements from and in front of said electrically conductive reflector means and in at least a first planar array, means for resistively loading the absorber elements, said array disposed at a distance from said reflector means, wherein said elements each comprise separate spiral patterns, wherein the separate patterns have different turn spacings.

59. Radar absorbing apparatus as set forth in claim 58 wherein said spiral patterns are concentric.

60. Radar absorbing apparatus as set forth in claim 59 wherein said outer patterns have greater turn spacing than the inner patterns.

61. Radar absorbing apparatus as set forth in claim 60 wherein the spiral patterns are isolated from each other.

62. Radar absorbing apparatus as set forth in claim 60 wherein said separate patterns are contiguously connected.

63. Radar absorbing apparatus for absorbing an electromagnetic energy wave having frequency signal content in a frequency range including 2–18 GHz, said apparatus comprising;

an electrically conductive reflector means, an array comprised of a plurality of discrete broadband impedance absorber elements, means for supporting said absorber elements from and in front of said electrically conductive reflector means and in at least a first planar array, means for resistively loading the absorber elements, said array disposed at a distance from said reflector means, wherein said means for supporting the elements is comprised of different segments of different dielectric constant with the different segments being associated respectively with the element and outside the element so to enable tuning of the array.

64. Radar absorbing apparatus for absorbing an electromagnetic energy wave having frequency singal content in a frequency range including 2–18 GHz, said apparatus comprising;

an electrically conductive reflector means, an array comprised of a plurality of discrete broadband impedance absorber elements, means for supporting said absorber elements from and in front of said electrically conductive reflector means and in at least a first planar array, means for resistively loading the absorber elements, said array disposed at a distance from said reflector means, wherein each element comprises a spiral element having a main spiral having plural open loops, in combination with plurality of smaller spirals disposed in the loops.

65. Radar absorbing apparatus as set forth in claim 64 wherein said main spiral includes a pair of contiguous spiral segments of different turns spacing.

66. Radar absorbing apparatus for absorbing an electromagnetic energy wave having frequency signal content in a frequency range including 2–18 GHz, said apparatus comprising;

an electrically conductive reflector means, an array comprised of a plurality of discrete broadband impedance absorber elements, means for supporting said absorber elements from and in front of said electrically conductive reflector means and in at least a first planar array, means for resistively loading the absorber elements, said array disposed at a distance from said reflector means, wherein said elements comprise first and second sets of spiral patterns, a first set being of spiral form and second set disposed in the interstitial spaces defined by the first set and being of modified spiral and complimentary form to the patterns of the first set.

67. Radar absorbing apparatus for absorbing an electromagnetic energy wave having frequency signal content in a frequency range including 2–18 GHz, said apparatus comprising;

an electrically conductive reflector means, an array comprised of a plurality of discrete broadband impedance absorber elements, means for supporting said absorber elements from and in front of said electrically conductive reflector means and in at least a first planar array, means for resistively loading the absorber elements, said array disposed at a distance from said reflector means, a second antenna array also comprised of a plurality of discrete absorber elements, and means for supporting said second array spaced from said first array remote from said reflector means.

68. Radar absorbing apparatus for absorbing an electromagnetic energy wave having frequency signal content in a frequency range including 2–18 GHz, said apparatus comprising;

an electrically conductive reflector means, an array comprised of a plurality of discrete broadband impedance absorber elements, means for supporting said absorber elements from and in front of said electrically conductive reflector means and in at least a first planar array, means for resistively loading the absorber elements, wherein the elements comprised first and second different size elements.

69. Radar absorbing apparatus for absorbing an electromagnetic energy wave incident thereupon having frequency signal content in a frequency range including 2–18 GHz, said apparatus comprising;

an electrically conductive reflector means, a substantially planar array comprised of a plurality of discrete and relatively spacially disposed broadband impedance absorber elements, means for supporting said absorber elements, said array disposed at a distance measured in the direction of propagation of said electromagnetic energy wave from said reflector means, said array characterized by having a resistivity in a range on the order of 0.04–2.0 ohms/square.

70. Radar absorbing apparatus as set forth in claim 69 wherein each broadband impedance absorber element comprises a spiral element.

71. Radar absorbing apparatus as set forth in claim 69 wherein said resistivity is obtained by resistively loading the impedance absorber elements by forming substantially the entire element by a resistive film.

72. Radar absorbing apparatus as set forth in claim 69 wherein said electrically conductive reflector means is disposed in a first plane and said planar array is disposed in a second plane substantially parallel to said first plane.

* * * * *